US011085282B2

(12) United States Patent
Mazrooee et al.

(10) Patent No.: US 11,085,282 B2
(45) Date of Patent: Aug. 10, 2021

(54) ADAPTIVE HYDRAULIC FRACTURING CONTROLLER FOR CONTROLLED BREAKDOWN TECHNOLOGY

(71) Applicant: Halliburton Energy Services, Inc., Houston, TX (US)

(72) Inventors: Mehdi Sebdani Mazrooee, Double Oak, TX (US); Michael Linley Fripp, Carrollton, TX (US); Matthew Lewis Lahman, Houston, TX (US); Mark Allen Adams, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 164 days.

(21) Appl. No.: 16/346,154

(22) PCT Filed: Dec. 29, 2017

(86) PCT No.: PCT/US2017/068891

§ 371 (c)(1),
(2) Date: Apr. 30, 2019

(87) PCT Pub. No.: WO2018/126106

PCT Pub. Date: Jul. 5, 2018

(65) Prior Publication Data

US 2020/0056466 A1 Feb. 20, 2020

Related U.S. Application Data

(63) Continuation-in-part of application No. PCT/US2016/069360, filed on Dec. 30, 2016.

(51) Int. Cl.
*E21B 43/26* (2006.01)
*E21B 47/06* (2012.01)
(Continued)

(52) U.S. Cl.
CPC ..... *E21B 43/267* (2013.01); *E21B 41/0092* (2013.01); *E21B 43/2607* (2020.05);
(Continued)

(58) Field of Classification Search
CPC .... E21B 43/26; E21B 43/2607; E21B 43/267; E21B 43/14; E21B 41/0092; E21B 47/06;
(Continued)

(56) References Cited

U.S. PATENT DOCUMENTS 5,517,854 A 5/1996 Plumb et al.
6,935,424 B2 8/2005 Lehman et al.
(Continued)

FOREIGN PATENT DOCUMENTS

WO 2011119668 A1 9/2011
WO WO-2015073005 A1 * 5/2015 ..... E21B 49/00
WO 2018125176 A1 7/2018

OTHER PUBLICATIONS

International Application No. PCT/US2017/068891, International Search Report, dated Apr. 26, 2018, 3 pages.
(Continued)

*Primary Examiner* — Taras P Bemko
*Assistant Examiner* — Yanick A Akaragwe
(74) *Attorney, Agent, or Firm* — Gilliam IP PLLC

(57) ABSTRACT

A method for hydraulically fracturing a subterranean formation includes sending a first command from a controller to a pump to achieve a first target flow rate for a fracturing fluid being injected into a subterranean formation during a fracturing operation. Monitoring an injection property of the fracturing operation. Determining a rate of change of the pressure over a first time period. Determining, by the controller, a second target flow rate based, at least in part, on the rate of change of the pressure. Sending a second com-
(Continued)

mand from the controller to the pump to achieve the second target flow rate for the fracturing fluid.

20 Claims, 10 Drawing Sheets

(51) Int. Cl.

| | |
|---|---|
| ***E21B 43/267*** | (2006.01) |
| ***E21B 41/00*** | (2006.01) |
| ***E21B 47/10*** | (2012.01) |
| ***F04B 15/00*** | (2006.01) |
| ***F04B 49/00*** | (2006.01) |

(52) U.S. Cl.
CPC ..... *E21B 47/06* (2013.01); *E21B 47/10* (2013.01); *F04B 15/00* (2013.01); *F04B 49/00* (2013.01); *F04B 2207/02* (2013.01)

(58) Field of Classification Search
CPC ..... E21B 47/10; F04B 15/00; F04B 49/00; F04B 2207/02
See application file for complete search history.

(56) References Cited

U.S. PATENT DOCUMENTS

| | | | | |
|---|---|---|---|---|
| 7,516,793 | B2 | 4/2009 | Dykstra | |
| 2009/0053072 | A1 | 2/2009 | Borgstadt et al. | |
| 2010/0224365 | A1 | 9/2010 | Abad | |
| 2010/0310384 | A1 | 12/2010 | Stephenson et al. | |
| 2015/0096739 | A1* | 4/2015 | Ghasripoor ..... | E21B 43/267 166/105 |
| 2016/0265330 | A1 | 9/2016 | Mazrooee et al. | |
| 2016/0273346 | A1 | 9/2016 | Tang et al. | |

OTHER PUBLICATIONS

International Application No. PCT/US2017/068891, International Written Opinion, dated Apr. 26, 2018, 10 pages.
CA Application No. 3040317, First Office Action dated Mar. 9, 2020, 4 pages.
International Application No. PCT/US2016/069360, International Search Report, Sep. 26, 2017 dated, 3 pages.
International Application No. PCT/US2016/069360, International Written Opinion, Sep. 26, 2017 dated, 13 pages.

* cited by examiner

ADAPTIVE HYDRAULIC FRACTURING CONTROLLER FOR CONTROLLED BREAKDOWN TECHNOLOGY

CLAIM FOR PRIORITY

The present application is a continuation-in-part of application no. PCT/US2016/069360, filed Dec. 30, 2016, which is hereby incorporated herein by reference in its entirety.

BACKGROUND

Subterranean hydraulic fracturing (alternately referred to as "fracking") is sometimes conducted to increase or stimulate production from hydrocarbon-producing wells. In hydraulic fracturing, a fracturing fluid is pumped at an elevated pressure from a wellbore into adjacent hydrocarbon-bearing subterranean formations. The pumped fracturing fluid splits or "fractures" the rock formation along veins or planes extending laterally from the wellbore. In some applications, the fracturing fluid contains propping agents (alternately referred to as "proppant") that are also injected into the opened fractures. Once a desired fracture network is formed, the fluid flow is reversed and the liquid portion of the fracturing fluid is removed. The proppant is intentionally left behind to prevent the fractures from closing onto themselves due to the weight and stresses within the formation. Accordingly, the proppant quite literally "props" or supports the fractures to remain open, yet remain permeable to hydrocarbon fluid flow since they form a packed bed of particles with interstitial void space connectivity.

Hydraulic fractures near the wellbore wall are ideally simple, straight, and wide to provide a direct fluid pathway between the wellbore and the deeper parts of the formation. Once farther into the formation, then it is preferable to generate a complex fracture network that maximizes reservoir contact.

While intended to enhance hydrocarbon production, hydraulic fracturing can occasionally damage rather than help the formation. One type of damage caused by hydraulic fracturing is referred to as "screenout," also known as "sandout." Screenout is a condition that occurs when the fracture network at or near the wellbore wall becomes too complex or restricted and the proppant substantially plugs the fractures and thereby prevents the fracturing fluid from flowing deeper into the formation at that location. Ramping up the flow rate too quickly during the initial stages of hydraulic fracturing is often the root-cause in screenout. Ramping up the flow rate too quickly, for example, causes rapid fluid pressurization in the wellbore (i.e., breakdown overpressure), which can lead to poor near wellbore fracture geometry, multiple competing fractures, and too many dominant fractures taking fluid, each of which can lead to premature screenout during later fracturing stages when proppant is introduced into the formation. When uncontrolled increases in flow rate are applied during initial fracturing, pressures quickly become too high, then, too many fractures near the wellbore wall may be taking fluid or they may follow torturous paths and, as a result, the widths of each fracture will become insufficient, causing fewer initial fractures to accept proppant during later pump stages. The remaining fractures would then remain untreated, resulting in significant bypassed oil and gas reserves in the reservoir.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to hydraulic fracturing of subterranean hydrocarbon-producing wells and, more particularly, to real-time and automatic control of hydraulic fracturing operations for stimulating the production of hydrocarbons.

Embodiments discussed herein describe the use of a hydraulic fracturing control system that incorporates a master controller used to provide automatic control over the stepped flow rate control for driving the fracture opening stages of the initial breakdown stages of hydraulic fracturing. The master controller operates and directs a series of pumps to control the flow rate output from each pump. The master controller commands the set point for each pump based on the available capacity of each pump, the relative output from each pump, and/or the total flow required into the wellbore. One advantage of the presently described embodiments is that the master controller determines the timing of the rate steps and/or the magnitude of the rate steps based on the pressure-time behavior of the injection process.

The systems and methods disclosed herein may be suitable for use during subterranean operations such as fracturing in the oil and gas industry. However, it will be appreciated that the various disclosed systems and methods are equally applicable during other subterranean operations, such as cementing, drilling, etc. as described above. Moreover, the systems and methods disclosed herein may be applicable to other fields requiring tunable fluids during operation including, but not limited to, the food industry, the drug industry, the mining industry, etc.

Figure 1:
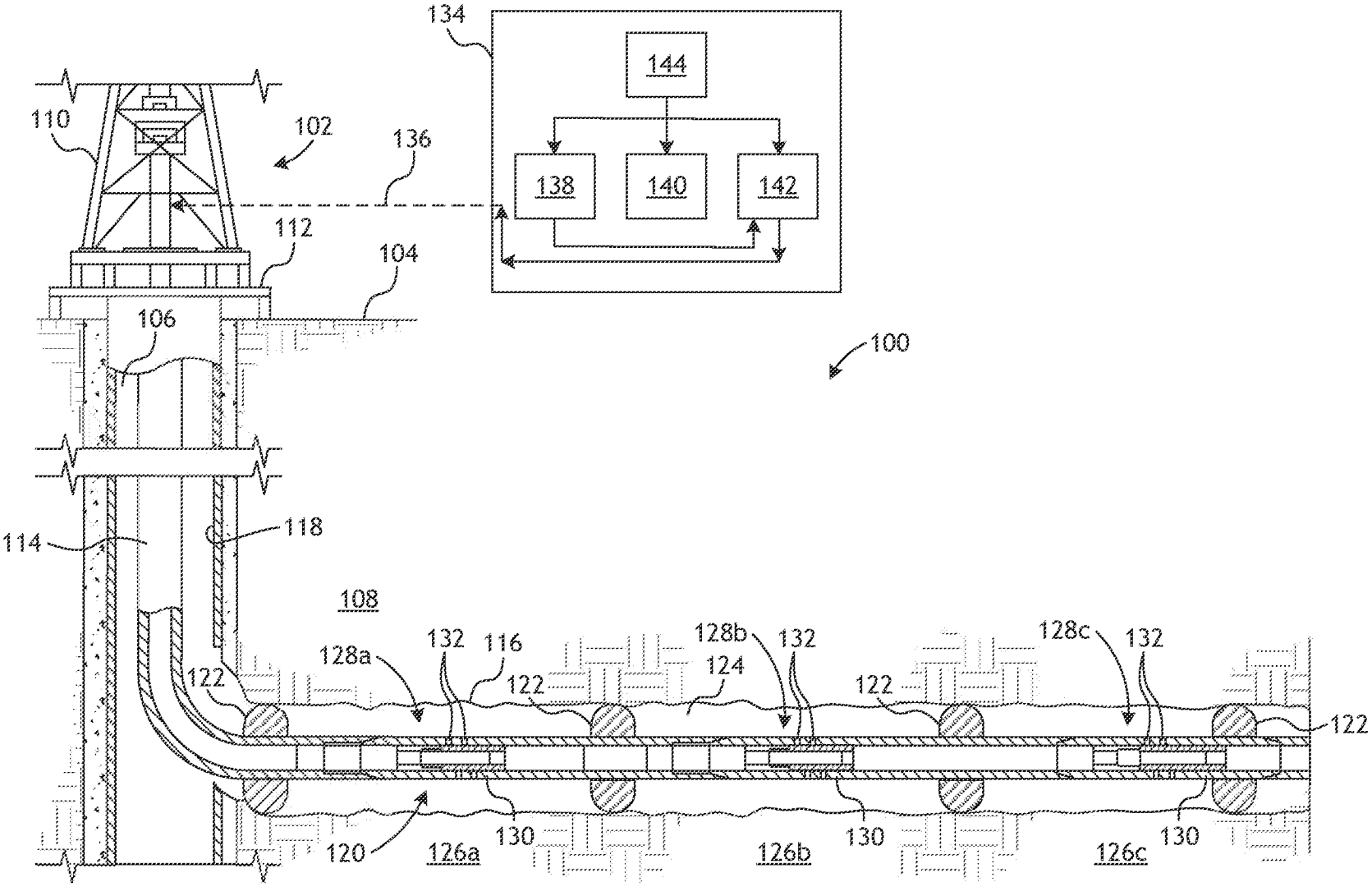
FIG. 1 illustrates an exemplary well system that can embody or otherwise employ one or more principles of the present disclosure.

FIG. 1 is a schematic diagram of an example well system 100 that can embody or otherwise employ one or more principles of the present disclosure, according to one or more embodiments. As illustrated, the well system 100 includes an oil and gas rig 102 arranged at the Earth's surface 104 and a wellbore 106 extends from the rig 102 and penetrates a subterranean earth formation 108. Even though FIG. 1 depicts a land-based rig 102, the embodiments of the present disclosure are equally well suited for use by other types of rigs, such as offshore platforms, or rigs used in any other geographical location. Moreover, in other embodiments, the rig 102 may be replaced with a wellhead installation, without departing from the scope of the disclosure.

The rig 102 may include a derrick 110 and a rig floor 112, and the derrick 110 may support or otherwise help manipulate the axial position of a work string 114 extended within the wellbore 106 from the rig floor 112. As used herein, the term "work string" refers to one or more types of connected lengths of tubulars or pipe, such as drill pipe, drill string, landing string, production tubing, coiled tubing, combinations thereof, or the like. The work string 114 may be used to stimulate (i.e., hydraulically fracture or "frack") portions of the wellbore 106 using the systems and methods described herein. In other embodiments, however, the work string 114 may be entirely omitted from the system 100 and the wellbore 106 may nonetheless be stimulated using the systems and methods described herein. Accordingly, inclusion of the work string 114 is for purposes of discussion only and should not be considered to limit the scope of the present disclosure.

As illustrated, the wellbore 106 extends vertically away from the surface 104 and a branch or lateral wellbore 116 extends laterally from the wellbore 106. Alternatively, the wellbore 106 itself may instead deviate from vertical to form the lateral wellbore 116 across a deviated or horizontal portion thereof. In an embodiment, the wellbore 106 may be at least partially lined with a casing string 118 or may otherwise remain at least partially uncased. The lateral wellbore 116 is depicted as an uncased or "open hole" section of the wellbore 106, but could alternatively be lined with the casing string 118 also.

In the illustrated embodiment, the work string 114 is coupled to a completion assembly 120 extended into and deployed in the lateral wellbore 116 using one or more packers 122. The packers 122 seal the annulus 124 defined between the completion assembly 120 and the inner wall of the wellbore 106 and thereby effectively divide the subterranean formation 108 into multiple production intervals 126 or "pay zones," shown as intervals 126*a*, 126*b*, and 126*c*. Each interval 126*a-c* may be independently or simultaneously stimulated (e.g., hydraulically fractured or "fracked") using the systems and methods described herein. While three production intervals 126*a-c* are shown in FIG. 1, any number of intervals 126*a-c* may be defined in the well system 100, including a single production interval, without departing from the scope of the disclosure.

In the illustrated embodiment, a sliding sleeve assembly 128 is arranged within the work string 114 at each interval 126*a-c* (shown as sliding sleeve assemblies 128*a*, 128*b*, and 128*c*). Each sliding sleeve assembly 128*a-c* may include a sliding sleeve 130 that is axially movable within the work string 114 to expose or occlude one or more ports 132 defined therein. Once exposed, the ports 132 may facilitate fluid communication into the annulus 124 from the interior of the work string 114 such that hydraulic fracturing operations may be undertaken in each corresponding interval 128*a-c*.

In other embodiments, however, the completion assembly 120 may be omitted from the well system 100 and the lateral wellbore 116 may instead be lined with casing (e.g., the casing string 118) and perforated in strategic locations to facilitate fluid communication between the interior of the casing and each corresponding interval 128*a-c*. In such embodiments, the wellbore 106 may nonetheless be stimulated using the systems and methods described herein by hydraulically fracturing the formation 108 via the perforations.

To facilitate hydraulic fracturing of the formation 108, the system 100 may also include a fracturing control system 134. The fracturing control system 134 communicates with the work string 114 (or alternatively the casing string 118) so that a prepared fracturing fluid 136 can be pumped down the work string 114 and into selected intervals 128*a-c* to fracture the formation 108 adjacent the corresponding intervals 128*a-c*. As illustrated, the fracturing control system 134 includes a fluid system 138, a proppant system 140, a pump system 142, and a master controller 144. In some embodiments, as illustrated, the fracturing control system 134 may be arranged at the surface 104 adjacent the rig 102. In other embodiments, however, at least the master controller 144 may be remotely located and able to communicate with the systems 138, 140, 142 via wired or wireless telecommunication means.

The fluid system 138 may be used to mix and dispense the fracturing fluid 136 having desired fluid properties (e.g., viscosity, density, fluid quality, etc.). The fluid system 138 may include a blender and sources of known substances that are combined in the blender to produce the fracturing fluid 136. The blending and mixing of the known substances is controlled under operation of the master controller 144.

The proppant system 140 may include proppant contained in one or more proppant storage devices, and a transfer apparatus that conveys the proppant from the storage device(s) to the fluid system 138 for blending. In some applications, the proppant system 140 may also include a proportional control device responsive to the master controller 144 to drive the transfer apparatus at a desired rate and thereby add a desired or predetermined quantity of proppant to the fracturing fluid 136.

The pump system 142 receives the prepared fracturing fluid 136 from the fluid system 138 and includes a series of positive displacement pumps (referred to as fracturing or "frac" pumps) that inject the fracturing fluid 136 into the wellbore 106 under specified pressures and at predetermined flow rates. Operation of the pumps of the pump system 142, including manipulation of the pump rate and pressure, is controlled by the master controller 144. Each pump may be indicative of a single, discrete pumping device, but could alternatively comprise multiple pumps included on or forming part of a pump truck stationed at or near the rig 102. All of the pumps (or pump trucks) included in the pump system 142 may or may not be the same type, size, configuration, or from the same manufacturer. Rather, some or all of the pumps may be unique in size, output capability, etc.

The master controller 144 includes hardware and software (e.g., a programmed computer) that allow a well operator to manually or autonomously control the fluid, proppant, and pump systems 138, 140, 142. Data from the fracturing operation, including real-time data from the wellbore 106 and the systems 138, 140, 142 is received and processed by the master controller 144 to provide monitoring and other informational displays to the well operator. In response to such real-time data, the master controller 144 provides control (command) signals to the systems 138, 140, 142 to trigger and adjust operation. Such control signals can either be conveyed manually, such as via functional input from the well operator, or automatically (autonomously), such as via programming included in the master controller 144 that automatically operates in response to real-time data triggers.

The master controller 144 may comprise an automated controller on a Controlled Breakdown Technology (CBT) management system. Controlled Breakdown Technology is a pressure-flow management procedure used in tight formations during the initial breakdown (fracturing) of a subterranean formation (e.g., the formation 108) and during the primary rate increase portion of the simulation treatment. This management procedure uses specific fluids for initiating the fractures and then uses a defined rate control logic to manage the pressure while achieving the designed job rate. In at least one embodiment, the CBT process may be initially used with low or no proppant concentration and the bulk of the proppant may instead be delivered at a later stage in the fracturing treatment.

The master controller 144 may be configured to issue control (command) signals that specify or dictate the flow rate produced by the pump system 142 and, more particularly, from each pump included therein. As described below, each pump may include a local controller and a dedicated local pump feedback loop. The local controller(s) may be configured and otherwise programmed to adjust local operation of the corresponding pump to match the flow rate specified (commanded) by the master controller 144. Thus, the fracturing control system 134 may include a nested series of local controllers that controls a corresponding series of pumps of the pump system 142, and the master controller 144 is programmed to coordinate and control the pumps based, at least in part, on feedback information obtained from the local pump feedback loops.

During the initial stages, and during the primary flow rate increase of the stimulation treatment, it is preferred to ramp the applied flow rate of the fracturing fluid 136 in stages or steps. This allows the resulting fractures to open and accommodate a higher flow in a step-wise fashion, which creates less complex fractures near the wall of the wellbore 106. By applying the flow rate and pressure in controlled steps, it is expected that all of the initial formation fractures will simultaneously take fluid and thereby mitigate or entirely prevent the occurrence of screenout (or "sandout").

According to embodiments of the present disclosure, operation of the master controller 144 may help provide efficient hydraulic fracturing that avoids or substantially avoids screenout events during the initial stages of fracturing the formation 108. As described herein below, the master controller 144 is programmed and otherwise configured to determine (calculate) and/or trigger when the next rate step should be applied and dictate how much of an increase in flow rate the next step should reflect. These parameters may be based on the pressure-time history of the hydraulic fracturing operation and the master controller 144 may be configured to automatically control the pumps of the pump system 142 to achieve a desired pressure profile at each stage of the operation.

In some embodiments, as described in more detail below, the master controller 144 may be programmed to employ automated algorithms that determine and apply a specific slope for each flow rate increase (the time to reach each set point), and a specific magnitude (flow rate in barrels per minute). As discussed below, the timing of each flow rate increase may be determined by the pressure-slope response of the previous rate step increase. Only when specific pressure response conditions to each rate step increase are observed will the next rate step be triggered by the master controller 144. In other embodiments, however, the master controller 144 may be programmed to employ automated algorithms that trigger a flow rate increase based on other operational or predetermined parameters, as described herein below.

Using the systems and methods described herein, a well operator will have control or influence over the propagation of the resulting fracture network. The result is improved fracture geometry, enhanced fracture breakdown, better flow distribution across (through) the fractures, and a significant improvement in intra-stage diversion. These performance advantages are in addition to the improvements in mitigating or entirely preventing screenout events.

Figure 2:
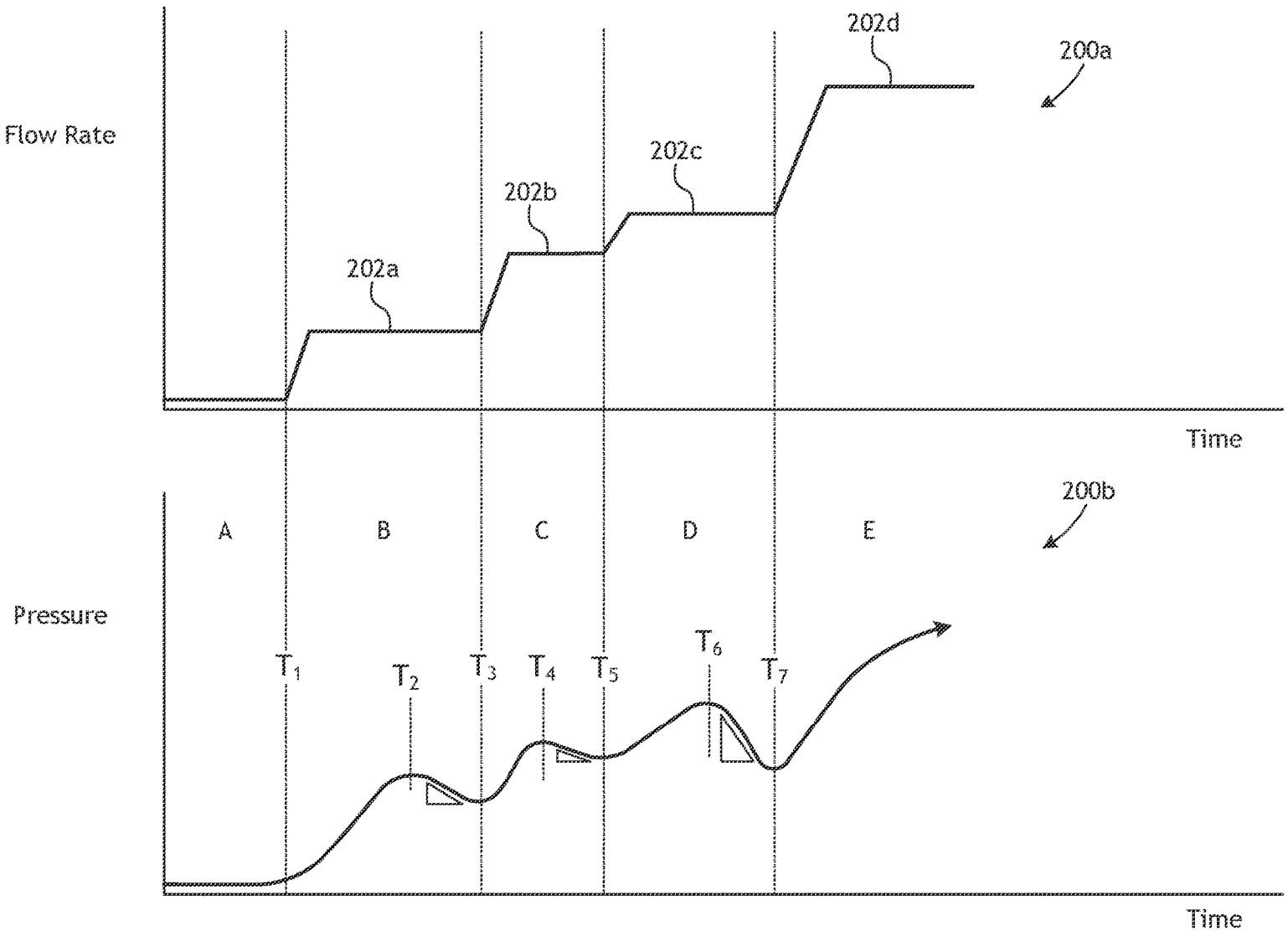
FIG. 2 depicts pressure and flow rate curves that reflect example automated operation of the fracturing control system of FIG. 1.

With continued reference to FIG. 1, FIG. 2 provides pressure-flow rate curves 200*a* and 200*b* that reflect example automated operation of the fracturing control system 134 of FIG. 1. More specifically, the first curve 200*a* provides example flow rate versus time data and the second curve 200*b* provides example pressure versus time data, where the time in each curve 200*a,b* is contiguous. The curves 200*a,b* are divided into five successive steps with respect to time, shown as step A, step B, step C, step D, and step E. Variations in each curve 200*a,b* are based partly on control dictated by the master controller 144, which is programmed to specify the flow rate for each pump of the pump system 142. As discussed below, the master controller 144 may also be programmed to monitor the pressure of the fracturing fluid 136 being delivered to the wellbore 106 and make any necessary flow rate adjustments to meet desired or predetermined fracturing pressures.

In example operation, as depicted in the curves 200*a,b*, across step A there is no flow rate and no applied pressure being delivered to the wellbore 106. At time $T_1$, however, the master controller 144 issues a first command signal to the pump system 142 that specifies a first increase in the flow rate for step B and the flow output from one or more pumps is thereby increased to a first target flow rate 202*a*. As a result, the wellbore pressure correspondingly increases but eventually reaches a maximum pressure for step B at time $T_2$, at which point the pressure may begin to decline (decrease). A second command signal may subsequently be issued to the pump system 142 by the master controller 144 at time $T_3$, which specifies a second increase in the flow rate corresponding to step C, and the flow output from the pump(s) is thereby increased to a second target flow rate 202*b*. The wellbore pressure again correspondingly increases but eventually reaches a maximum pressure for step C at time $T_4$, at which point the pressure may again begin to decrease.

A third command signal may subsequently be issued to the pump system 142 by the master controller 144 at time $T_5$, which specifies a third increase in the flow rate corresponding to step D, and the flow output from the pump(s) is thereby increased to a third target flow rate 202*c*. As a result, the wellbore pressure correspondingly increases but eventually reaches a maximum pressure for step D at time $T_6$, at which point the pressure may again begin to decrease. Lastly, a fourth command signal may subsequently be issued to the pump system 142 by the master controller 144 at time $T_7$, which specifies a fourth increase in the flow rate corresponding to step E, and the flow output from the pump(s) is thereby increased to a fourth target flow rate 202*d* and the wellbore pressure correspondingly increases. This process continues until a predetermined maximum target flow rate and pressure for the wellbore 106 is reached.

In some embodiments, the time between reaching a maximum pressure in a given step and the time when a new command signal is sent by the master controller 144 to increase the flow rate to a new target flow rate may be based on the determination (calculation) of a negative slope in the pressure-time curve 200*b* after reaching the maximum pressure in the given step. In other words, the time lapse between time $T_2$ and time $T_3$ (or alternatively between time $T_4$ and time $T_5$ or between time $T_6$ and time $T_7$) may encompass the time required to determine if the slope of the pressure-time curve 200*b* following time $T_2$ is negative, which would provide positive indication that the wellbore pressure is declining. Accordingly, once a negative slope following time $T_2$ is determined, the master controller 144 may be configured to issue the second command signal $T_3$. In the illustrated example, there are similar negative slopes in the pressure-time curve 200*b* between time $T_4$ and time $T_5$ and between time $T_6$ and time $T_7$, which results in corresponding third and fourth command signals being issued by the master controller 144 to increase the flow rate at time $T_5$ and time $T_7$, respectively.

In other embodiments, the time between reaching a maximum pressure in a given step and the time when a new command signal is sent by the master controller 144 to increase the flow rate to a new target flow rate may comprise a predetermined value. In other words, the time lapse between times $T_2$ and $T_3$ (or alternatively between times $T_4$ and $T_5$ or between times $T_6$ and $T_7$) can comprise a predetermined value. This predetermined value may be, for example, a predetermined or predefined time period, such as 1 second, 2 seconds, 5 seconds, 10 seconds, 30 seconds, more than 30 seconds, any time therebetween, or any time prior to 1 second (i.e., a split second) or after 30 seconds. The predetermined value may alternatively be based on wellbore data, such as the type of formation rock being fractured or historical logging data points.

In yet other embodiments, the time between reaching a maximum pressure in a given step (e.g., time $T_2$, $T_4$, or $T_6$) and the time when a new command signal is sent by the master controller 144 to increase the flow rate to a new target flow rate (e.g., time $T_3$, $T_5$, or $T_7$) may be adjusted based on the time elapsed between issuing the prior command signal and reaching the previous maximum pressure. In other words, the time between times $T_2$ and $T_3$ (or alternatively between times $T_4$ and $T_5$ or between times $T_6$ and $T_7$) can be adjusted based on the time elapsed between time $T_1$, when the first command signal was issued, and time $T_2$, when the wellbore pressure reached the maximum pressure for step B. Similar determinations (calculations) may be made between times $T_3$ and $T_4$ or between times $T_5$ and $T_6$.

In some embodiments, the flow rate increase to each step A, B, C, D may be the same and otherwise at a consistent (constant) rate across each step A, B, C, D. In such embodiments, the command signals issued by the master controller 144 may be configured to increase the flow rate at times $T_1$, $T_3$, $T_5$, and $T_7$ by a predetermined and comparable (similar) rate such that the target flow rate for each step A, B, C, D reflects flow rate increases at the same rate or intensity. As a result, the magnitude of each flow rate increase may be similar in one or both of the curves 200*a,b*. Consequently, in such embodiments, the commanded change (increase) in flow rate at time $T_1$ would be the same as the commanded increase at times $T_3$, $T_5$, and $T_7$. In other embodiments, however, the rate of increase of the flow rate at each step A, B, C, D need not be consistent (constant) across each step A, B, C, D. Rather, in such embodiments, the master controller 144 may be programmed to specify a variable rate of increase.

In yet other embodiments, the flow rate increase initiated at times $T_1$, $T_3$, $T_5$, and $T_7$ may be based on a parameter of the pressure-time curve 200*b* across the preceding step A, B, C, D. For example, the command signals issued by the master controller 144 may be configured to increase the flow rate at times $T_1$, $T_3$, $T_5$, and $T_7$ based on the slope of the pressure-time curve across the preceding step A, B, C, D, respectively. In some cases, the flow rate increase may be based on the slope of the pressure-time curve 200*b* during a pressure decrease. In such cases, the flow rate change at time $T_3$ would be a function of the slope of the pressure-time curve 200*b* between times $T_2$ and $T_3$. Similarly, the pressure slope after time $T_4$ is shallower (less aggressive) and thus the flow rate increase is smaller at time $T_5$, and the pressure slope after time $T_6$ is steeper (more aggressive) and, thus, the rate increase is larger at time $T_7$. In other cases, however, the flow rate increase may be based on the slope of the pressure-time curve 200*b* during a pressure increase, such as between times $T_1$ and $T_2$, times $T_3$ and $T_4$, and times $T_5$ and $T_6$, without departing from the scope of the disclosure.

In some applications, the pressure-time curve 200*b* may never register a decrease within a given step A, B, C, D, unlike the pressure decreases depicted between times $T_2$ to $T_3$, $T_4$ to $T_5$, and $T_6$ to $T_7$. In such applications, the master controller 244 may be programmed to eventually "time out" as it waits for an inflection point in the pressure-time curve 200*b*. More specifically, if too much time elapses after reaching a maximum pressure in a given step without measuring an inflection point in the pressure-time curve 200*b*, the master controller 144 may be programmed to issue a new command signal to increase the flow rate to a new target flow rate. In some embodiments, the "time out" period may be a predetermined value, such as the predetermined or predefined time limit discussed above (e.g., 1 second, 2 seconds, 5 seconds, 10 seconds, 30 seconds, more than 30 seconds, etc.). In other embodiments, the "time out" period may be determined based on the slope of the pressure-time curve 200*b* during a pressure increase or decrease. In yet other embodiments, the "time out" period may be the time elapsed during the previous step. In even further embodiments, the "time out" period may be a combination of any of the foregoing.

Figure 3:
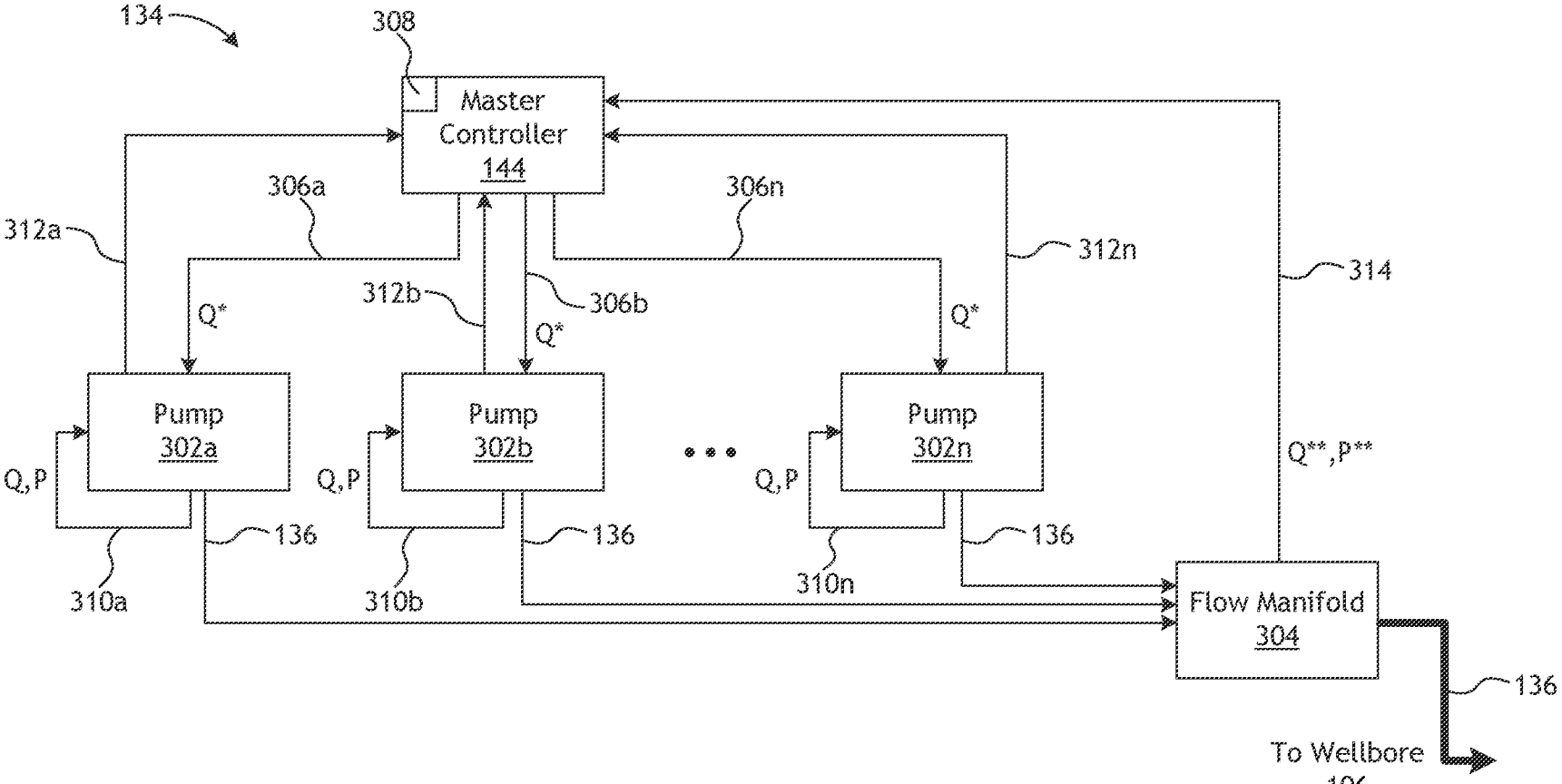
FIG. 3 is a schematic diagram of the control layout for the master controller of FIG. 1.

FIG. 3 is a schematic diagram of the control layout for select features of the fracturing control system 134 of FIG. 1, according to one or more embodiments. In the illustrated schematic, the fracturing control system 134 includes a plurality of pumps, shown as pumps 302*a*, 302*b*, . . . , and 302*n*, where each pump 302*a-n* forms part of the pump system 142 of FIG. 1. Use of the variable "n" with respect to pump 302*n* indicates that any number of pumps may be used in the fracturing control system 134, without departing from the scope of the disclosure. Each pump 302*a-n* may be indicative of a single, discrete pump, but, as mentioned above, could alternatively comprise multiple pumps included on or forming part of a pump truck stationed at a rig site. The output of each pump 302*a-n* comprises fracturing fluid 136 that is conveyed to a flow manifold 304 where the separate streams of fracturing fluid 136 are combined to be fed into the wellbore 106, such as via a wellhead installation or the like.

The master controller 144 is programmed and otherwise configured to control operation of the pumps 302*a-n* such that a predetermined or required flow rate and pressure of the fracturing fluid 136 is conveyed to the wellbore 106. To accomplish this, the master controller 144 issues or provides discrete command signals to each pump 302*a-n*, shown in FIG. 3 as command signals 306*a*, 306*b*, . . . , and 306*n*. The command signals 306*a-n* may be conveyed via any known wired or wireless telecommunication means. Each command signal 306*a-n* directs the corresponding pump 302*a-n* to operate such that a predetermined flow rate of the fracturing fluid 136 is conveyed to the flow manifold 304 for introduction into the wellbore 106.

The master controller 144 may be configured to define each pump 302*a-n*, which includes storing operational and device parameters for each pump 302*a-n* in an onboard memory 308. Each pump 302*a-n*, for example, may include multiple sequential gears used to dictate the resulting flow rate producible by each pump 302*a-n*, and such device parameters may be stored in the onboard memory 308. Accordingly, the master controller 144 may be able to access and query pump capabilities and limitations for each pump 302*a-n* and, based on the known operational and device parameters, the master controller 144 may be programmed to define an order that the pumps 302*a-n* are engaged (initiated) during operation to reach a target flow rate for each incremental flow rate step. The master controller 144 further ensures that each pump 302*a-n* that is part of a flow rate step increase is quickly ramped up to a lockout point (i.e., operating in a desired gear) and any additional pumps 302*a-n* required to achieve the target flow rate at the given step are engaged via the command signals 306*a-n*.

The master controller 144 may be configured to automatically adjust the required flow rate for the fracturing operation based on real-time operational parameters and information, and thereby ensure that proper ramping up to each target flow rate is achieved. To accomplish this, the fracturing control system 134 may include multiple feedback loops. As illustrated, for example, each pump 302*a-n* in the fracturing control system 134 may include a local feedback loop, shown as local feedback loops 310*a*, 310*b*, . . . , 310*n*. Moreover, each pump 302*a-n* may further include a master feedback loop, shown as master feedback loops 312*a*, 312*b*, . . . , 312*n*. The local and master feedback loops 310*a-n*, 312*a-n* may each comprise, for example, a closed-loop control mechanism or program, such as a proportional controller (P), a differential controller (D), an integrative controller (I), or a combination thereof such as a PID (proportional, integral, derivative) controller. In some embodiments, each pump 302*a-n* may include an adaptive controller, a feedforward controller, a sliding mode controller, or a state space controller. In yet other embodiments, the pumps 302*a-n* may be operated in an open loop mode without utilizing local feedback such as the local feedback loops 310*a*, 310*b*, . . . , 310*n*.

The local feedback loops 310*a-n* monitor and control the output of each corresponding pump 302*a-n*. More particularly, the real-time flow rate Q and pressure P of each pump 302*a-n* may be measured downstream from its corresponding outlet. The local feedback loops 310*a-n* allow the measured flow rate Q to be compared against the commanded flow rate Q* dictated by the corresponding command signal 306*a-n* provided by the master controller 144. If there is a difference between the measured flow rate Q and the commanded flow rate Q*, the pump 302*a-n* may include local controllers configured to automatically adjust its operation to account for the difference and bring the measured flow rate Q into operational alignment with the commanded flow rate Q*. Each local feedback loop 310*a-n* may have different control gains based on the particular pump gear, the measured flow rate Q, the commanded flow rate Q*, or the measured pressure P.

Each master feedback loop 312*a-n* provides operational feedback data to the master controller 144 from each pump 302*a-n*. The operational feedback data provided to the master controller 144 can include the real-time measured flow rate Q and measured pressure P. The measured pressure P, for instance, may be used as a conditioner on the master controller 144 to ensure that the given pump 302*a-n* does not adjust into a region of instability, inefficiency, excessive wear, or otherwise undesirable poor performance. Additional operational feedback data provided to the master controller 144 from each pump 302*a-n* may include, but is not limited to, the currently-engaged pump gear, the commanded flow rate Q*, the minimum flow rate capacity in the currently-engaged pump gear, the maximum flow rate capacity in the currently-engaged pump gear, the minimum and/or maximum flow rate capacity in the next pump gear, the maximum pressure in the currently-engaged pump gear, the maximum pressure in the next pump gear, and the kick out pressure (i.e., the maximum pressure for the wellbore 106). Based on the operational feedback data, the master controller 144 may be configured to alter (modify) operation of one or more of the pumps 302*a-n* by sending additional command signals 306*a-n*. For instance, the master controller 144 may place the pumps 302*a-n* in a certain operational sequence or order based on the operational feedback data and engage (operate) the pumps based on that certain order.

In some embodiments, each pump 302*a-n* provides all of the aforementioned operational feedback data to the master controller 144 via its corresponding master feedback loop 312*a-n*. In other embodiments, one or more of the pumps 302*a-n* may provide different amounts of the aforementioned operational feedback data to the master controller 144, without departing from the scope of the disclosure. In some applications, the most important operational feedback data provided to the master controller 144 via the master feedback loops 312*a-n* may be the measured flow rate Q from each pump 302*a-n* and the maximum flow rate capacity in the currently-engaged pump gear. Instead of providing the measured flow rate Q, the actual value provided to the master controller 144 may be the rotations per minute (RPM) of the corresponding pump 302*a-n* or some other parameter that can be used to calculate the measured flow rate Q. The master controller 144 could also use the measured RPM and skip calculation of the measured flow rate Q, as long as the parameter is correlated with the flow rate.

In some embodiments, the fracturing control system 134 may further include a target feedback loop 314 providing the master controller 144 with feedback data corresponding to the real-time, measured total flow rate Q and total pressure P of the fracturing fluid 136 being conveyed into the wellbore 106. The total pressure P of the fracturing fluid 136 can be measured at various locations prior to the wellbore 106. In the illustrated embodiment, for example, the total pressure P can be measured at the flow manifold 304. In other embodiments, however, the total pressure P can be measured prior to the flow manifold 304 but after the pumps 302***a-n* or after the flow manifold 304. The total flow rate Q may similarly be measured before, at, or after the flow manifold 304. Based on the real-time, measured total flow rate Q and total pressure P of the fracturing fluid 136, the master controller 144 may be configured to alter (modify) operation of one or more of the pumps 302***a-n* by sending additional command signals 306*a-n*.

In some embodiments, the local feedback loops 310*a-n* may be omitted from the fracturing control system 134. In such embodiments, the pumps 302*a-n* may be run on an "open loop" configuration that receives the commanded flow rate Q* from the master controller 144. The master controller 144 can either specify a desired pump gear for the commanded flow rate Q* or each pump 302*a-n* can autonomously determine the appropriate gear based on the commanded flow rate Q*. Moreover, in an open loop configuration, the master controller 144 continues to sequence the pumps 302*a-n* to balance the load across the pumps 302*a-n*. The pumps 302*a-n* would continue to operate in the same operating pressure regime so that a rise in the injection pressure at the wellbore 106 would affect all of the pumps 302*a-n* at about the same pressure range.

Figure 4:
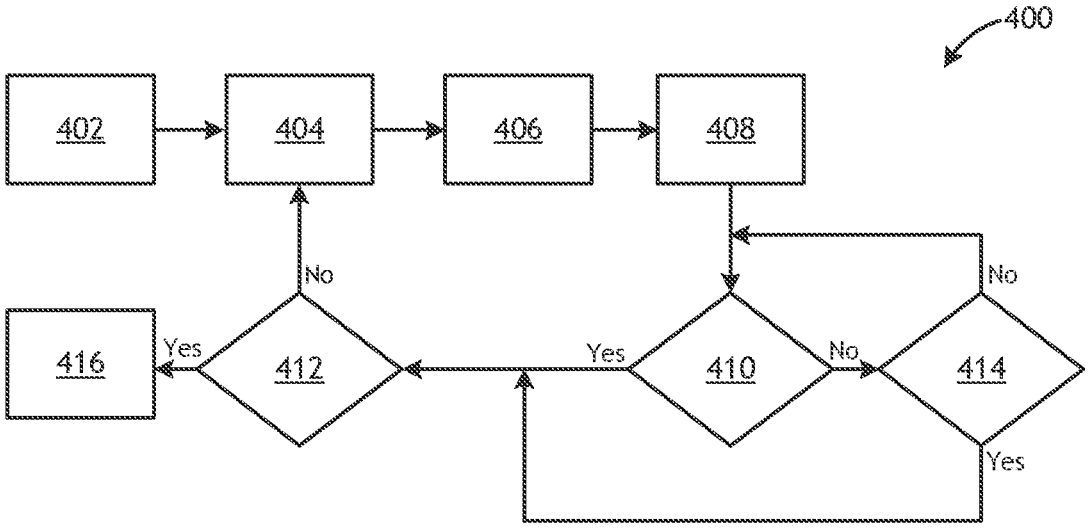
FIG. 4 is a schematic flow diagram of example operation of the master controller of FIG. 1.

FIG. 4 is a schematic flow diagram 400 of example operation of the fracturing control system 134, according to one or more embodiments. It is noted that the flow diagram 400 is only one example of operating the fracturing control system 134 and, therefore, should not be considered to limit the scope of the present disclosure. Prior to using the fracturing control system 134 to control a hydraulic fracturing operation, a user (e.g., a well operator) will input the following user-defined variables into the master controller 144: $Q_{Max}$, $P_{Max}$, $Q_{step}$, $T_{Wait}$, $T_{Eval}$, and $\Delta P_{Min}$:

- $Q_{Max}$: measured in barrels per minute (BPM), $Q_{Max}$ is the maximum flow rate to be reached during the hydraulic fracturing operation, at which point the fracturing control system 134 is turned off or placed on idle so as to not damage the wellbore 106 (FIG. 1).
- $P_{Max}$: measured in pounds per square inch (PSI) or Pascals (Pa), $P_{Max}$ is the maximum pressure value to be reached during the hydraulic fracturing operation.
- $Q_{Step}$: also measured in BPM, $Q_{Step}$ is the total magnitude set point for each incremental flow rate step increase.
- $T_{Wait}$: the minimum holding time before the slope of the pressure-time curve 200*b* (FIG. 2) is evaluated and a subsequent flow rate step increase is performed. $T_{Wait}$ allows the fracturing control system 134 to stabilize.
- $\Delta T_{Eval}$: the fixed time period lapsed before positively determining a decrease in pressure or the slope of the pressure-time curve 200*b*; $T_{Eval}=T_{Current}-\Delta T_{Eval}$.
- $\Delta P_{Min}$: the minimum pressure drop required to initiate the next flow rate step increase and may be measured from when $T_{Wait}$ is achieved or may alternatively be measured over a real-time progressing evaluation of the pressure ($P_{Eval}$).

With reference to the flow diagram 400, the fracturing control system 134 is first turned "on" or initiated, as at box 402. Once the fracturing control system 134 is turned on, the master controller 144 may be triggered to initiate the first flow rate step increase at the input magnitude flow rate $Q_{Step}$, as at box 404. In some cases, the first flow rate step $Q_{Step}$ increase may comprise the closest achievable (rounded up) value based on the types of pumps (e.g., pumps 302*a-n* of FIG. 3) used, the flow manifold 304 (FIG. 3), and/or the desired treating pressure for the first step. Eventually, the target flow rate for the first step will be reached, as at box 406. At this point, the flow rate will be held (maintained) for the $T_{Wait}$ period before any evaluation or sequential flow rate step decisions are made, as at 408.

Once the $T_{Wait}$ period expires, the pressure may be evaluated by comparing the pressure measured back in time defined by $T_{Eval}$ ($P_{Eval}$) against the current pressure ($P_{Current}$) to determine if the pressure has exceeded an input pressure threshold ($\Delta P_{Min}$) requirement (e.g., $P_{Eval}-P_{Current})\geq\Delta P_{Min}$), as at diamond 410, where $P_{Eval}$ is the pressure at $T_{Current}-\Delta T_{Eval}$. If the input pressure threshold $\Delta P_{Min}$ is met upon expiration of $T_{Wait}$ ("YES"), or over future $T_{Eval}$ periods, a check of the maximum flow rate $Q_{Max}$ and the maximum pressure $P_{Max}$ may be made, as at diamond 412. If, however, the input pressure threshold $\Delta P_{min}$ is not met upon expiration of $T_{Wait}$ ("NO"), the current pressure $P_{Current}$ will be continuously monitored until either the input pressure threshold $\Delta P_{min}$ is met or until expiration of a maximum holding time period for each step ($T_{Max}$), as at diamond 414. In some embodiments, $T_{Max}$ may be a period fixed as a multiple of $T_{Wait}$ (e.g., $T_{Max}=5\times T_{Wait}$). Accordingly, at diamond 414, as long as the current time TCurrent is less than the maximum holding time $T_{Max}$ ("NO"), the current pressure $P_{Current}$ will be continuously monitored until the input pressure threshold $\Delta P_{min}$ is met. If, however, the $T_{Max}$ period expires ("YES"), the maximum flow rate $Q_{Max}$ and the maximum pressure $P_{Max}$ will be measured, as at diamond 412.

If the maximum flow rate $Q_{Max}$ and the maximum pressure $P_{Max}$ are not met at diamond 412 ("NO"), the next flow rate step increase in the fracturing process may commence by initiating a second flow rate step increase at the input magnitude flow rate $Q_{Step}$, as at box 404 again. The method may then proceed as outlined above from box 404. If, however, the maximum flow rate $Q_{Max}$ and/or the maximum pressure $P_{Max}$ are met ("YES"), then operation of the fracturing control system 134 may be shut down or placed on hold, as at box 416. If the fracturing control system 134 is placed on hold, the fracturing process will be maintained at the current state and some or all of the timing parameters (e.g., $T_{Max}$, $T_{Wait}$, $T_{Current}$, $T_{Eval}$, etc.) will be placed on hold until the fracturing control system 134 is removed from hold. While the fracturing control system 134 is placed on hold, the master controller 144 will be unable to make any more steps or decisions.

In some embodiments, the fracturing control system 134 may operate according to a set of rules. One rule programmed into the fracturing control system 134 and, more particularly into the master controller 144, may be that while the rate step magnitude $Q_{Step}$ is user defined, it is limited by the lock-up of the gears of the pumps 302*a-n* (FIG. 3), since pump transmissions have limited range of efficient operation. If the rate step magnitude $Q_{Step}$ does not fit within the operating range of the pump gears, then the master controller 144 may be programmed to specify a different flow rate that matches the efficient flow rate steps available by the pumps 302*a-n*. In other words, if an input rate step magnitude $Q_{Step}$ is lower than the minimum engagement rate for the number of pumps 302*a-n* required, then the rate step magnitude $Q_{Step}$ may be increased to the minimum set point achievable for the number of pumps 302*a-n* required. This rule is based upon the mechanical capability of the pumps 302*a-n* (e.g., the pump truck carrying the pumps 302*a-n*).

Another rule that may be applied (programmed) to the fracturing control system 134 may be that the time ($\Delta T_{Eval}$) required to evaluate a decrease in pressure or the slope of the pressure-time curve 200*b* (FIG. 2) must be less than or equal to the minimum holding time ($T_{Wait}$) before the slope of the pressure-time curve 200*b* is evaluated and a subsequent flow rate step increase is performed. Since $\Delta T_{Eval}$ may be a fixed number, it should not be larger than $T_{Wait}$. If it were larger than $T_{Wait}$, a pressure reading could be obtained before the rate step was actually taken.

Yet another rule that may be applied (programmed) to the fracturing control system 134 may be that the pump rate allocation logic will first engage all the pumps 302*a-n* (FIG. 3) sequentially as required by flow rate needs. The flow rate of each pump 302*a-n* may then be increased as needed. Unless a particular pump has been excluded from the available pump list by the well operator, or if a pump has been set by the well operator to engage in a higher gear than the lowest lock up gear, all pumps 302*a-n* will be engaged in the lowest available lock up gear before any other pump is brought to the next highest gear.

Figure 5:
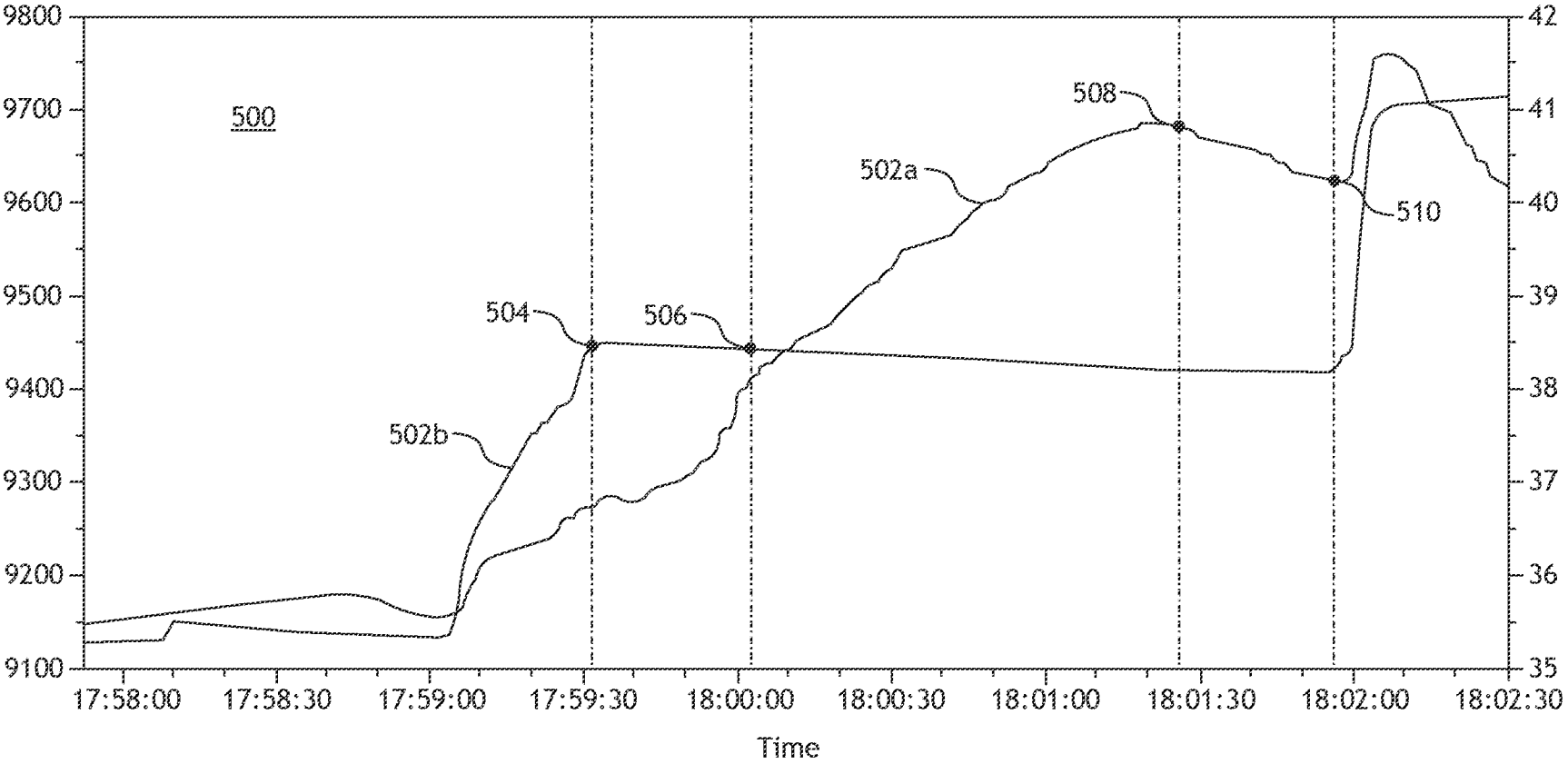
FIG. 5 is a plot that reflects example automated operation of the fracturing control system of FIG. 1.

FIG. 5 is a plot 500 showing example automated operation of the fracturing control system 134. The plot 500 includes a pressure curve 502*a* and a flow rate curve 502*b* each plotted contiguously against time (x-axis). At about time 17:59:00, the fracturing control system 134 is turned on and the master controller 144 initiates the first flow rate increase. The flow rate increases until reaching a target flow rate set point 504, at which point the flow rate is maintained while the pressure continues to increase. At point 506, the minimum holding time ($T_{Wait}$) has been reached and evaluation of $\Delta P_{min}$ can begin. In some applications, as illustrated, the flow rate may gently (slightly) decrease with time, but could alternatively gently (slightly) increase with time or remain substantially constant. A flow rate increase is not initiated until about time 18:01:25 because $\Delta P_{min}$ has not been satisfied nor has $T_{Max}$ been reached. At point 508, however, the pressure curve 502*a* begins to decrease, which may refer to the time ($T_{Eval}$) required before a decrease in the slope of the pressure curve 502*a* can be detected (i.e., $\Delta T_{Eval}$=time at point 510−time at point 508). At point 510, the current pressure ($P_{Current}$) is measured to determine if the minimum pressure drop is reached, $(P_{Eval}-P_{Current})\geq\Delta P_{Min}$ at which point another flow rate increase is initiated for the next step. The plot 500 shows that a flow rate step is not taken based upon measured time only, but also relying on measured pressure data.

Figure 6:
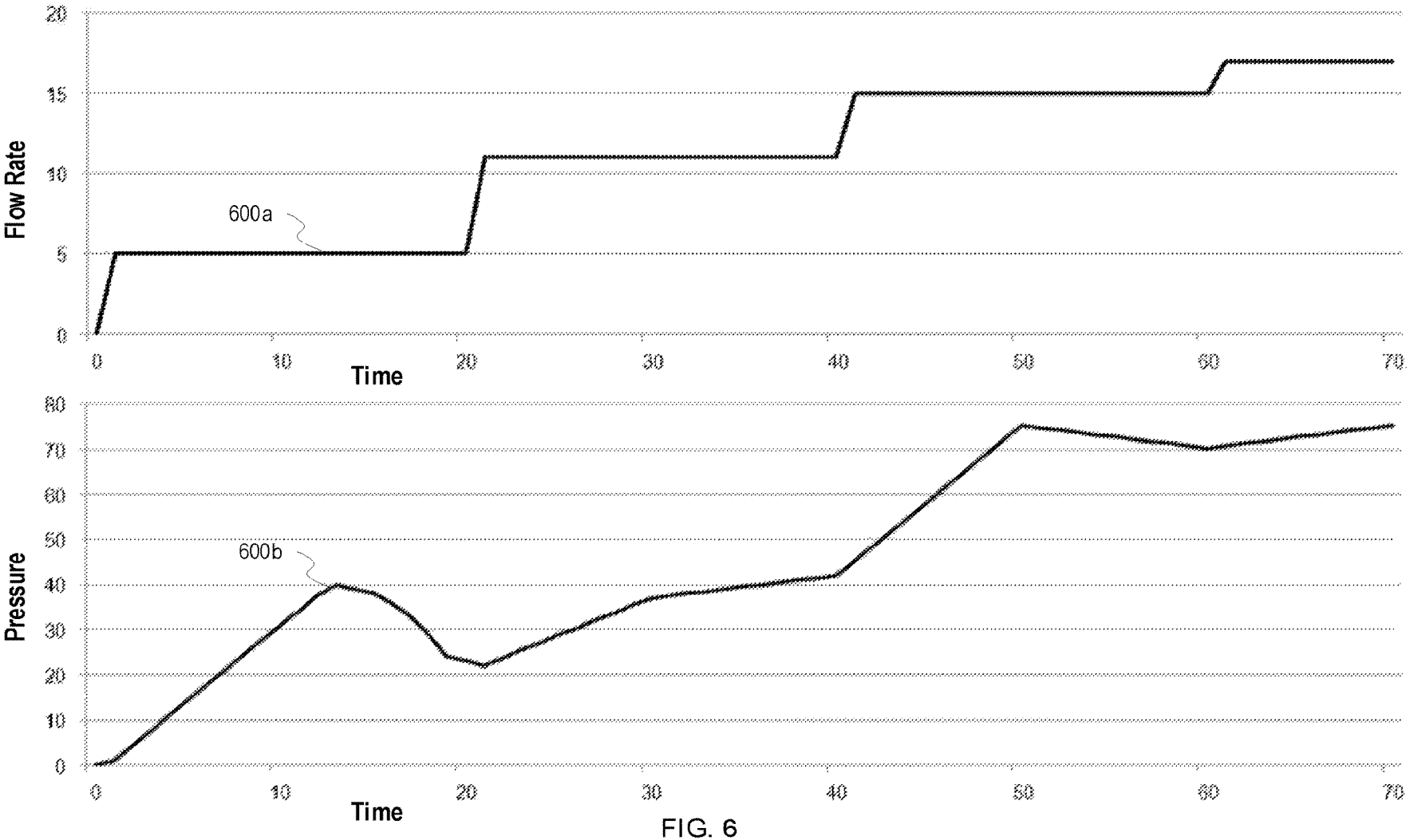
FIG. 6 depicts pressure and flow rate curves that reflect example automated operation of the fracturing control system of FIG. 1.

With continued reference to FIG. 1, FIG. 6 provides pressure-flow rate curves 600*a* and 600*b* that reflect example automated operation of the fracturing control system 134 of FIG. 1. FIG. 6 illustrates adaptive determinations of flow rate increases based on observed rates of change in pressure. The first curve 600*a* provides example flow rate versus time data and the second curve 600*b* provides example pressure versus time data, where the time in each curve 600*a,b* is contiguous. The values depicted for the curves 600*a,b* are simplified for purposes of explanation and may not reflect actual values experienced during a fracturing operation.

Variations in each curve 600*a,b* are based partly on control dictated by the master controller 144, which is programmed to specify the flow rate for each pump of the pump system 142. The master controller 144 is also programmed to monitor the pressure of the fracturing fluid 136 being delivered to the wellbore 106 and make any necessary flow rate adjustments to meet desired or predetermined fracturing pressures. To determine the magnitude of flow rate adjustments, the master controller 144 calculates an average rate of change in the pressure over a time period, e.g. over a 10-second time window. The master controller 144 uses the average rate of change to determine flow rate changes that are responsive to the experienced changes in pressure. If a function for pressure is given by P(t), the rate of change or slope for pressure at a given point in time can be expressed as follows:

$$\text{Pressure Rate of Change} = \frac{dP(t)}{dt} \tag{1}$$

The average pressure rate of change over a time period may be expressed as follows:

$$\text{Average Pressure Rate of Change} = \frac{1}{t_2 - t_1}\int_{t_1}^{t_2}\frac{dP(t)}{dt} \tag{2}$$

Based on the average rate of change, the master controller 144 can determine an appropriate flow rate step or can increase or reduce a predetermined flow rate step for application at a next stage in the fracturing process. The master controller 144 may compare the average rate of change to predetermined thresholds or pressure change ranges to determine the necessary adjustments to flow rate. For example, the master controller 144 may be configured with pressure rate change thresholds of 75 PSI/min and 150 PSI/min. The thresholds can be associated with rules or formulas which indicate adjustments to be made to a next flow rate step. For example, if the master controller 144 detects a pressure rate of change greater than the 150 PSI/min threshold over a given time window, the master controller 144 may decrease the next flow rate step by 50%.

Furthermore, the master controller 144 may monitor the average pressure rate of change to detect when a flow rate step should be applied. As described above, the master controller 144 can determine that a flow rate step should be applied once a maximum pressure has been reached and the pressure begins decreasing. Similarly, when monitoring the average pressure rate of change, the master controller 144 determines that a flow rate step should be applied if the average rate of change over a given time window is negative. Also, even if the pressure is increasing, the master controller 144 can determine that a flow rate step should be applied if the average pressure rate of change is below a threshold, e.g. 30 PSI/min. Additional detail is provided below in relation to FIG. 6.

In FIG. 6, at time 0, the master controller 144 begins the fracturing operation and issues a first command signal to the pump system 142 that specifies a first target flow rate of 5. The first target flow rate may be determined based on a predetermined flow rate step (i.e., a predetermined step of 5 which increases the flow rate from 0 to 5). Subsequent step increases may be determined in relation to the predetermined step increase. The master controller 144 also begins monitoring the pressure and begins calculating a rate of change in pressure. In the time window 0-10, the master controller 144 calculates a positive rate of change indicating that the pressure is increasing. The master controller 144 determines that the rate of change is increasing within acceptable parameters and maintains the current flow rate.

For the time window from 10-20, the average pressure rate of change is negative, indicating decreasing pressure. As a result, the master controller 144 determines that the flow rate should be increased. The master controller 144 analyzes the pressure rate of change over the time window to determine whether the predetermined flow rate step increase should be adjusted. Since the pressure is decreasing, the master controller 144 compares the average pressure rate of change for the time window to a threshold for a negative rate of change. This threshold is associated with a formula indicating that, if the pressure is decreasing at a rate which exceeds the threshold, the predetermined flow rate step should be increased by 20% for the next step increase. Based on the pressure data in FIG. 6, the master controller 144 determines that the negative average rate of change for the pressure exceeds the threshold and that the predetermined flow rate step should be increased by 20% from 5 to 6.

At time 20, the master controller 144 applies the adjusted flow rate step of 6 by issuing a command signal to the pump system 142 to increase the flow rate from 5 to a new target flow rate of 11. After applying a flow rate step, the master controller 144 analyzes the pressure rate of change over an initial time window to determine whether adjustments should be made for the next flow rate step. If the pressure is increasing too rapidly after increasing the flow rate, the master controller 144 determines that the next flow rate step should be reduced. The amount by which the next flow rate step is reduced is based on various thresholds. For example, the master controller 144 may be configured with pressure rate change thresholds of 75 PSI/min and 150 PSI/min. In FIG. 6, the average pressure rate of change over the time window 20-30 is 100 PSI/min. Since the average rate of change falls within a middle range of the thresholds, the master controller 144 applies a moderate reduction and reduces the next flow rate step by 33% compared to the previous flow rate step, changing the step from 6 to 4.

The master controller 144 applies the adjusted flow rate step at a next time instance in which the measured pressure indicates that the flow rate should be increased. For example, the master controller 144 may apply the flow rate step once a decrease in pressure over a time window is detected. Additionally, the master controller 144 may be configured to increase the flow rate if the average rate of change for the pressure falls below a threshold, even if the pressure is increasing. In FIG. 6, the master controller 144 determines that the average rate of change over the time window 30-40 is below a threshold. As a result, the master controller 144 applies the adjusted flow rate step of 4 at time 40 to increase the flow rate from 11 to a new target flow rate of 15.

For the time window 40-50, the master controller 144 analyzes the pressure rate of change over the time window to determine whether adjustments should be made for the next flow rate step. Similar to the operations at time window 20-30 described above, the master controller 144 determines an amount by which the next flow rate step is reduced based on various thresholds, such as 75 PSI/min and 150 PSI/min. In FIG. 6, the average pressure rate of change over the time window 40-50 is 200 PSI/min, exceeding the higher threshold of 150 PSI/min. Since the average rate of exceeds the higher threshold, the master controller 144 applies a more significant reduction and reduces the previous flow rate step by 50%, changing the step from 4 to 2.

For the time window from 50-60, the master controller 144 determines that the pressure is decreasing and, as a result, that the flow rate should be increased. At time 60, the master controller 144 applies the adjust flow rate step of 2 to increase the flow rate from 15 to a new target flow rate of 17. The master controller 144 continues monitoring the pressure rate of change and determine flow rate step increases for the duration of the fracturing operation.

The master controller 144 may be configured with a minimum and maximum allowable flow rate step increase. For example, a flow rate step increase may have a minimum of 2 BPM and a maximum of 10 BPM. The minimum and maximum values may be based on technical limitations of the pump system 142 such as a maximum flow rate of the pump system 142, gear ratios of pumps in the pump system 142 which affect granularity of flow rate changes, etc. The minimum and maximum values override any changes to a flow rate step increase which would exceed or fall below the values.

In the description above, the master controller 144 begins monitoring the pressure at time 0 and continues determining an average pressure rate of change for each of the 10-second time windows. In some embodiments, the master controller 144 may not begin monitoring the pressure rate of change until after an initialization time period, such as 20 seconds. Additionally, the master controller 144 may allow time for initialization and stabilization of the flow rate after each application of a flow rate step. In other embodiments, the master controller 144 may calculate average pressure rate changes periodically, such as every minute, every third time window, etc. In other embodiments, the master controller 144 may calculate average pressure rate changes continuously over a window that continuously moves in time.

In the description above, the master controller 144 adjusts the flow rate step based on the injection property of a time rate of change of pressure. The master controller 144 can also adjust the flow rate step based on the current pressure measurement. For example, as the pressure increases, the master controller 144 may adjust or tighten thresholds, i.e. 75 PSI/min may be lowered to 50 PSI/min. Additionally, the master controller 144 can adjust the flow rate steps based on other parameters or injection properties including pressure amplitude, hydraulic power, rotations per minute (RPM) of pumps in the pump system 142, or the rate of change of any of these parameters. For example, the master controller 144 may monitor the rate of change of the hydraulic power and RPMs after applying a flow rate step. If either parameter exceeds a threshold, the master controller 144 may determine that the flow rate step was too large and reduce the next flow rate step.

Figure 7:
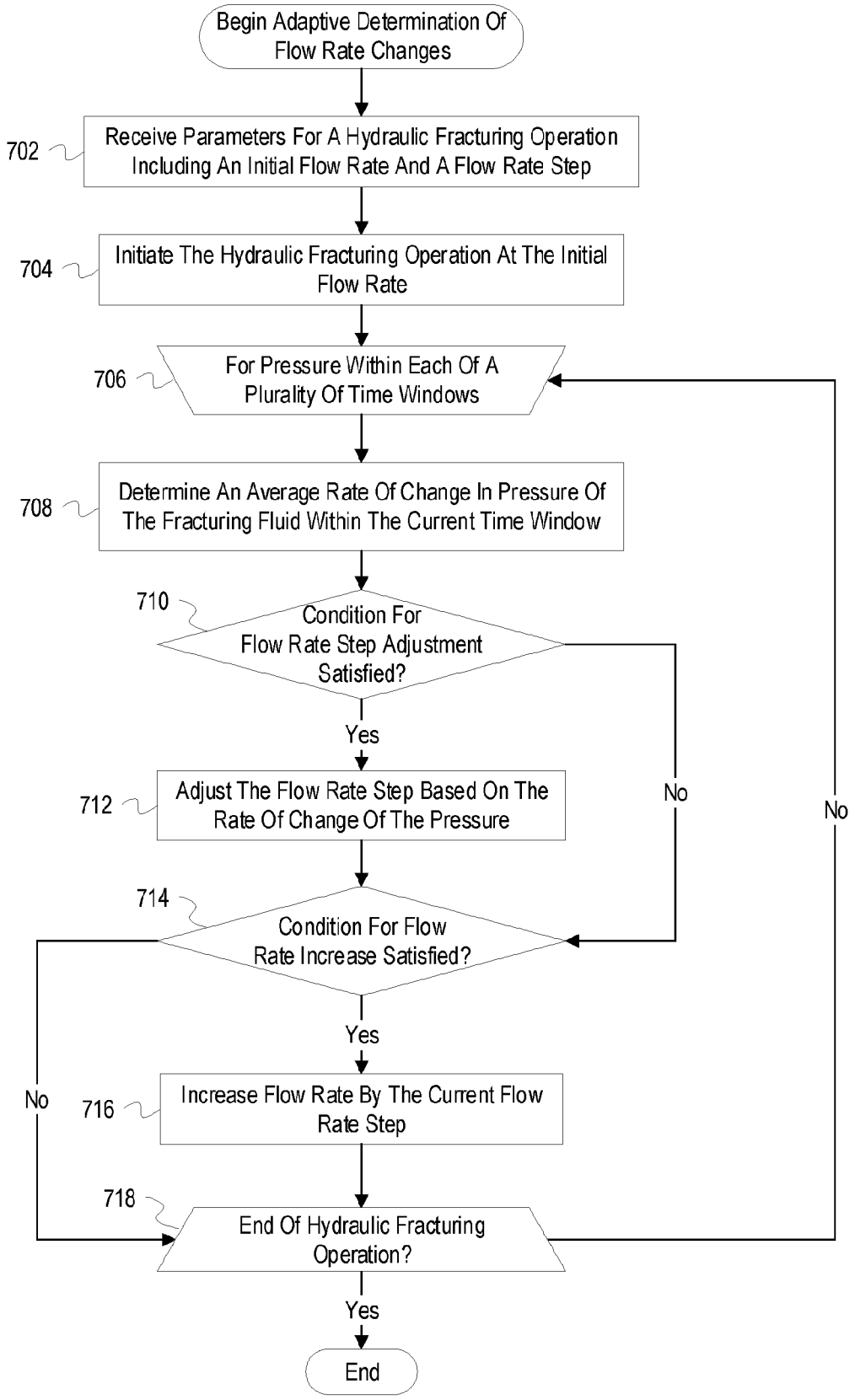
FIG. 7 is a schematic flow diagram of example operation of the master controller of FIG. 1.

FIG. 7 is a flowchart of example operations for determining adaptive flow rate step increases during a fracturing operation. FIG. 7 refers to a master controller as performing the operations for naming consistency with the above Figures, although the naming of software/hardware can vary among implementations.

A master controller receives parameters for a hydraulic fracturing operation including a first flow rate and a flow rate step (702). The initial flow rate is the first target flow rate at which the hydraulic fracturing operations begins. As the operation continues, the flow rate is modified in relation to the initial flow rate according to the flow rate step. The master controller is also configured with parameters which indicate thresholds and ranges for acceptable or target conditions during the fracturing operation, especially a measured pressure rate of change. The master controller adjusts the flow rate as described below based on a value of pressure rate of change in relation to the indicated thresholds.

The master controller initiates the hydraulic fracturing operation at the initial flow rate (704). The master controller transmits a command signal to a pump system to begin pumping fluid at the initial flow rate.

The master controller begins monitoring pressure over a plurality of time windows (706). The time windows may be contiguous and of a specified length, such as 20 seconds. In some embodiments, the time windows may not be contiguous, e.g. a first window from 0-10, then a next window from 15-25, or may be overlapping, e.g. a first window from 0-10 and a next window from 5-10. The time window for which the master controller is currently analyzing is hereinafter referred to as the current time window.

The master controller determines an average rate of change in pressure of the fracturing fluid within the current time window (708). The master controller receives feedback from one or more sensors which measure pressure of the fluid being pumped. Based on these measurements, the master controller calculates an average rate of change in fluid pressure. The measurements may be nearly continuous over the current window or may be sampled, e.g., one measurement every second.

The master controller determines whether a condition for a flow rate step adjustment has been satisfied (710). The master controller compares the average rate of change for the current window to thresholds or ranges indicated in the parameters. If the average rate of change is within an acceptable range, the master controller may not adjust the flow rate, i.e. a condition for changing the flow rate step has not been satisfied. If the average rate of change exceeds or falls below an indicate threshold, the master controller determines that the flow rate step should be adjusted, i.e. a condition has been satisfied.

If the master controller determines that a condition for a flow rate step adjustment has been satisfied, the master controller adjusts the flow rate step based on the average rate of change of the pressure (712). The master controller determines a threshold or range in which the average rate of change falls and adjusts the flow rate step in accordance with an associated rule or formula. For example, the master controller may adjust the flow rate step up or down in accordance with an indicated percentage. The master controller may calculate the adjustment using a most recently applied flow rate step value or using the flow rate step indicated in the parameters at block 702. In some embodiments, each threshold may be associated with a predetermined flow rate step, so the master controller determines the new flow rate step to be the predetermined flow rate step for that range. In some embodiments, a next target flow rate may be determined based on a function which includes the average pressure rate of change as a variable. For example, the flow rate function may be:

$$\text{Rate}\ (t+1) = \text{Rate}\ (t) * \left(1 - \frac{\text{Average}\left(\frac{dP(t)}{dt}\right) - 75}{300}\right) \tag{3}$$

Rate(t+1) is the next flow rate, and Rate(t) is the current flow rate which is adjusted according to the average rate of change for a current time window. The values 75 and 300 can be tuned according to parameters for a given fracturing operation.

After adjusting the flow rate step or after determining that the flow step should not be adjusted, the master controller determines whether a condition for increasing the flow rate has been satisfied (714). A condition for increasing the flow rate may be determining that the pressure is decreasing over the current time window, the pressure is increasing at a rate below a specified threshold, a command to increase the flow rate has been received, or a maximum time for the current flow rate has expired. The maximum time for a flow rate may be specified in the parameters at block 702 and can be adjusted in response to changes in the average rate of change calculated over consecutive time windows. To determine whether the maximum time should be adjusted, the master controller compares the average rate of change for the current time window to the average rate of change for a previous time window. If the average rate of change is increasing, then the master controller may extend the maximum time by a specified value, e.g. 30 seconds, or by a percentage. Conversely, if the average rate of change is decreasing, the master controller may decrease the maximum time so that a condition to increase the flow rate will be triggered sooner.

After determining that the flow rate should be increased, the master controller increases the flow rate in accordance with the current flow rate step (716). The master controller determines the new flow rate by increasing the current flow rate in accordance with the calculated flow rate step. The master controller transmits a command signal to a pump system to begin pumping fluid at the new target flow rate.

After increasing the flow rate or after determining that the flow rate should be increased, the master controller determines whether the hydraulic fracturing operation is complete (718). If the hydraulic fracturing operation is not complete, the master controller continues monitoring the pressure for a next time window. If the hydraulic fracturing operation is complete, the process ends.

Although FIG. 7 focuses on monitoring pressure, the master controller can perform similar operations based on other injection properties such as a pressure amplitude, hydraulic power, and RPM of the pump.

Figure 8:
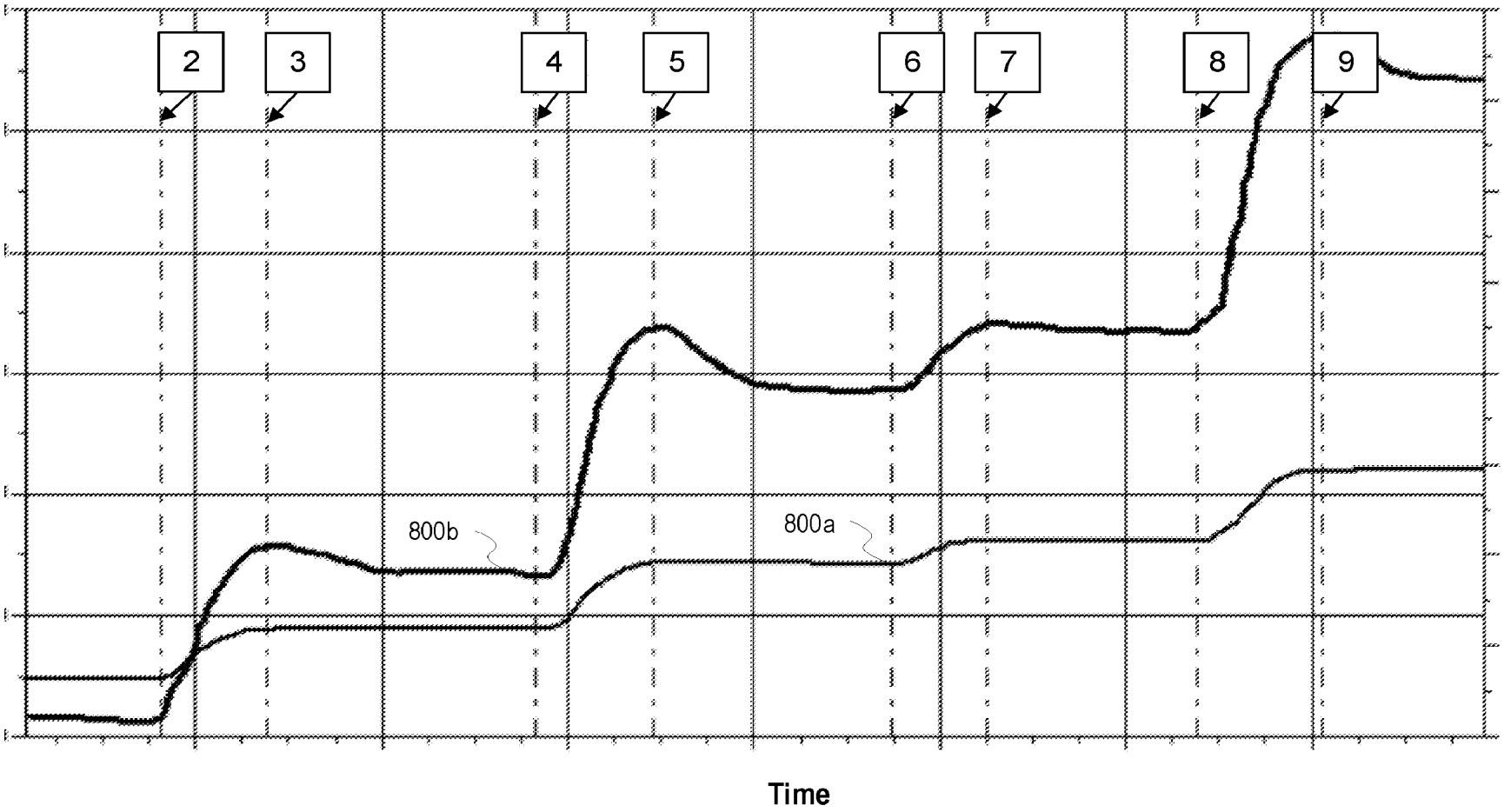
FIG. 8 depicts pressure and flow rate curves that reflect example automated operation of the fracturing control system of FIG. 1.

FIG. 8 depicts pressure and flow rate curves that reflect example automated operation of the fracturing control system of FIG. 1. FIG. 8 illustrates adaptive determinations of flow rate increases based on observed amplitudes in a pressure curve. The first curve 800*a* provides example flow rate versus time data and the second curve 800*b* provides example pressure versus time data, where the time in each curve 800*a,b* is contiguous. The values depicted for the curves 800*a,b* are simplified for purposes of explanation and may not reflect actual values experienced during a fracturing operation.

Similar to FIG. 6 and FIG. 7, the master controller 144 is programmed to monitor the pressure of the fracturing fluid 136 being delivered to the wellbore 106 and make any necessary flow rate adjustments to meet desired or predetermined fracturing pressures. To determine the magnitude of flow rate adjustments, the master controller 144 calculates an amplitude of the pressure in response to applying a flow rate step, i.e. a difference between a measured pressure prior to applying the flow rate step and a subsequent peak of the pressure curve after changing the flow rate. FIG. 8 depicts points 2-9 which are points in time at which measurements in the pressure curve 800*b* are taken for purposes of calculating a pressure amplitude. Each pair of points 2-9 (e.g., points 2 and 3, 4 and 5, etc.) are used to determine an amplitude of the pressure curve 800*a* which changes in response to applying a flow rate step. For example, the point 2 corresponds to a trough in the pressure curve 800*b* prior to applying a flow rate step, and the point 3 corresponds to a peak after the application of a flow rate step. The master controller 144 determines the amplitude by subtracting the trough pressure measurement at point 2 from the peak pressure measurement at point 3. The pressure measurements at points 2, 4, 6, and 8 correspond to times at which the master controller 144 detected a condition for increasing the flow rate. Although shown as troughs in the pressure curve 800*b*, in some instances, the pressure measurements used for calculating the amplitude may not necessarily correspond to a trough in the pressure curve 800*b*. For example, the master controller 144 may determine to increase the flow rate if the pressure is increasing below a threshold rate of change. Since the pressure is still increasing, the measured pressure used for calculating the amplitude will not be a trough in the pressure curve 800*b* as the master controller 144 uses a pressure measurement taken at a time of detecting that a flow rate step should be applied. In general, the pressure measurements used for calculating the pressure amplitude may be the pressure prior to (or at) the application of the flow rate step and the pressure a fixed time after the application of the flow rate step or at a peak pressure.

Similar to the thresholds for pressure time rate of change, the master controller 144 can compare the amplitude of the pressure curve 800*b* to thresholds to determine whether a next flow rate step should be increased or decreased. For example, if the pressure amplitude exceeds a threshold of 400 PSI, the master controller 144 may decrease the flow rate step by 30%. The master controller 144 can also express the amplitude of the pressure in relation to the flow rate, Q, as follows:

$$\text{Pressure Rate of Change in relation to Flow Rate} = \frac{dP(t)}{dQ} = \frac{P(\text{peak}) - P(\text{before step})}{Q(\text{peak}) - Q(\text{before step})} \quad (4)$$

The expression Q(peak)−Q(before step) is equal to the applied flow rate step, i.e. a change in flow rate. The expression P(peak)−P(before step) is equal to the pressure amplitude calculated as described above. As opposed to the pressure rate of change based on time described in FIG. 6, formula 4 above results in a pressure rate of change which is based on the change in flow rate. Pressure rate of change in relation to the flow rate can indicate a degree of sensitivity in response to flow rate changes for a formation. A larger value for the pressure rate of change in relation to flow rate indicates that the formation is more sensitive to flow rate changes. The master controller 144 can reduce a flow rate step for more sensitive formations or increase a flow rate step for less sensitive formations.

Figure 9:
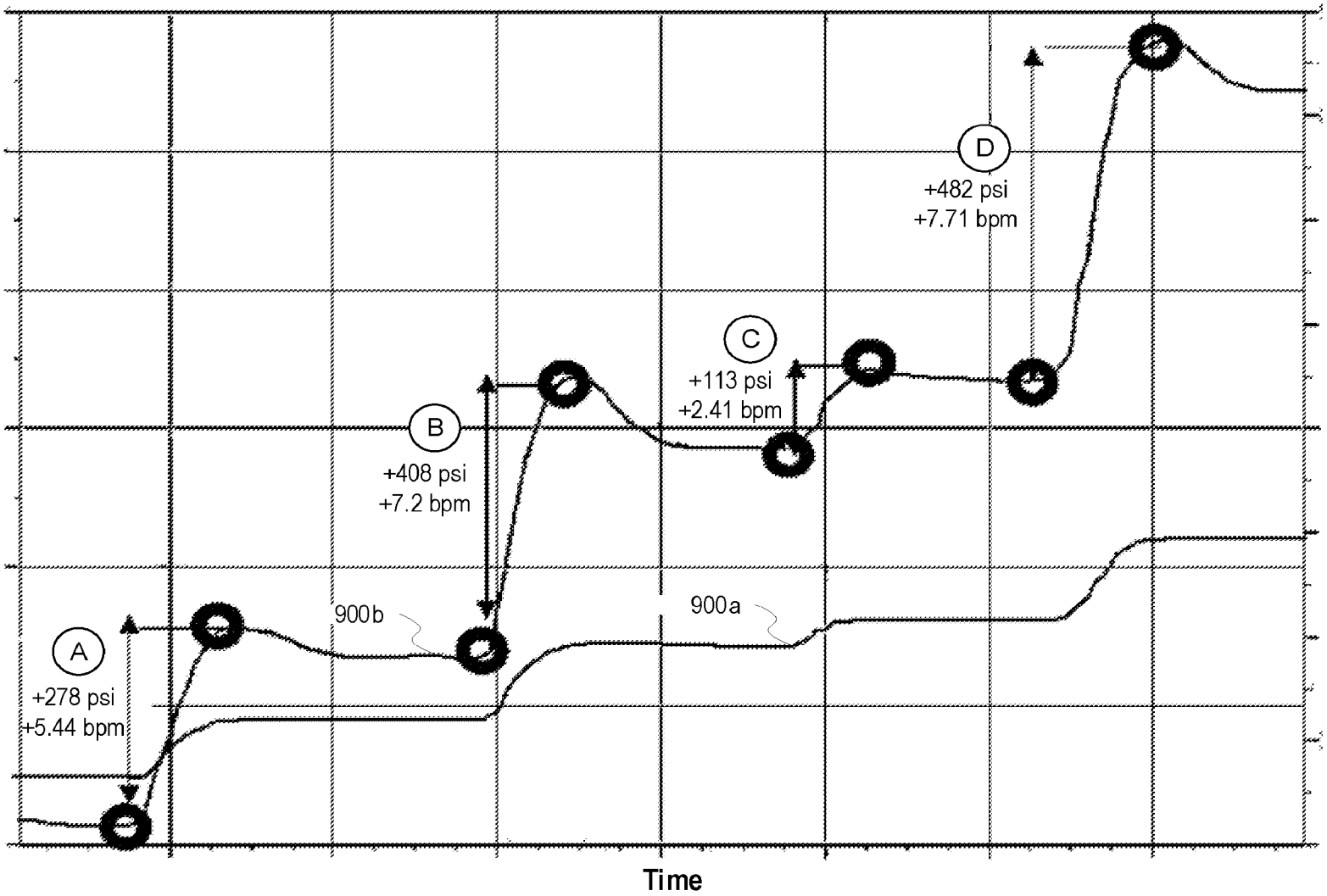
FIG. 9 depicts pressure and flow rate curves that reflect example automated operation of the fracturing control system of FIG. 1.

FIG. 9 depicts pressure and flow rate curves that reflect example automated operation of the fracturing control system of FIG. 1. FIG. 9 depicts pressure amplitude calculations for a pressure curve 900*b* which changes in response to a flow rate curve 900*b*. FIG. 9 depicts pressure amplitudes at four stages A, B, C, and D. At each stage, the master controller 144 determines that the flow rate should be increased and applies a flow rate step. The master controller 144 adjusts the flow rate steps based on the pressure amplitudes at each stage.

At stage A, the master controller 144 increases the flow rate by 5.44 BPM and calculates a pressure amplitude of 278 PSI. Based on this amplitude, the master controller 144 increases the flow rate step to be applied at stage B. The master controller 144 may, for example, increase the flow rate step based on a percentage associated with a threshold or range in which the measured amplitude falls. At stage B, the master controller 144 applies a flow rate step of 7.2 BPM and calculates a pressure amplitude of 408 PSI. Based on the larger pressure amplitude, the master controller 144 determines that the flow rate step should be decreased. At stage C, the master controller 144 applies a flow rate step of 2.41 BPM and calculates a pressure amplitude of 113 PSI. At stage D, the master controller 144 applies an increased flow rate step of 7.71 BPM and calculates a pressure amplitude of 482 PSI. The master controller 144 continues operating in this manner until a fracturing operation is complete.

The pressure amplitude in response to a flow rate change can be used in conjunction with the other injection properties. For example, the master controller 144 may make a first adjustment to the next flow rate step based on pressure amplitude and then make additional adjustments based on one or more of pressure time rate of change, hydraulic power, or RPM. The master controller 144 may consider each injection property individually or in combination when determining a flow rate step adjustment.

Variations

The various embodiments described herein are directed to computer control for the master controller 144 and use various blocks, modules, elements, components, methods, and algorithms that can be implemented using computer hardware, software, combinations thereof, and the like. To illustrate this interchangeability of hardware and software, various illustrative modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Figure 10:
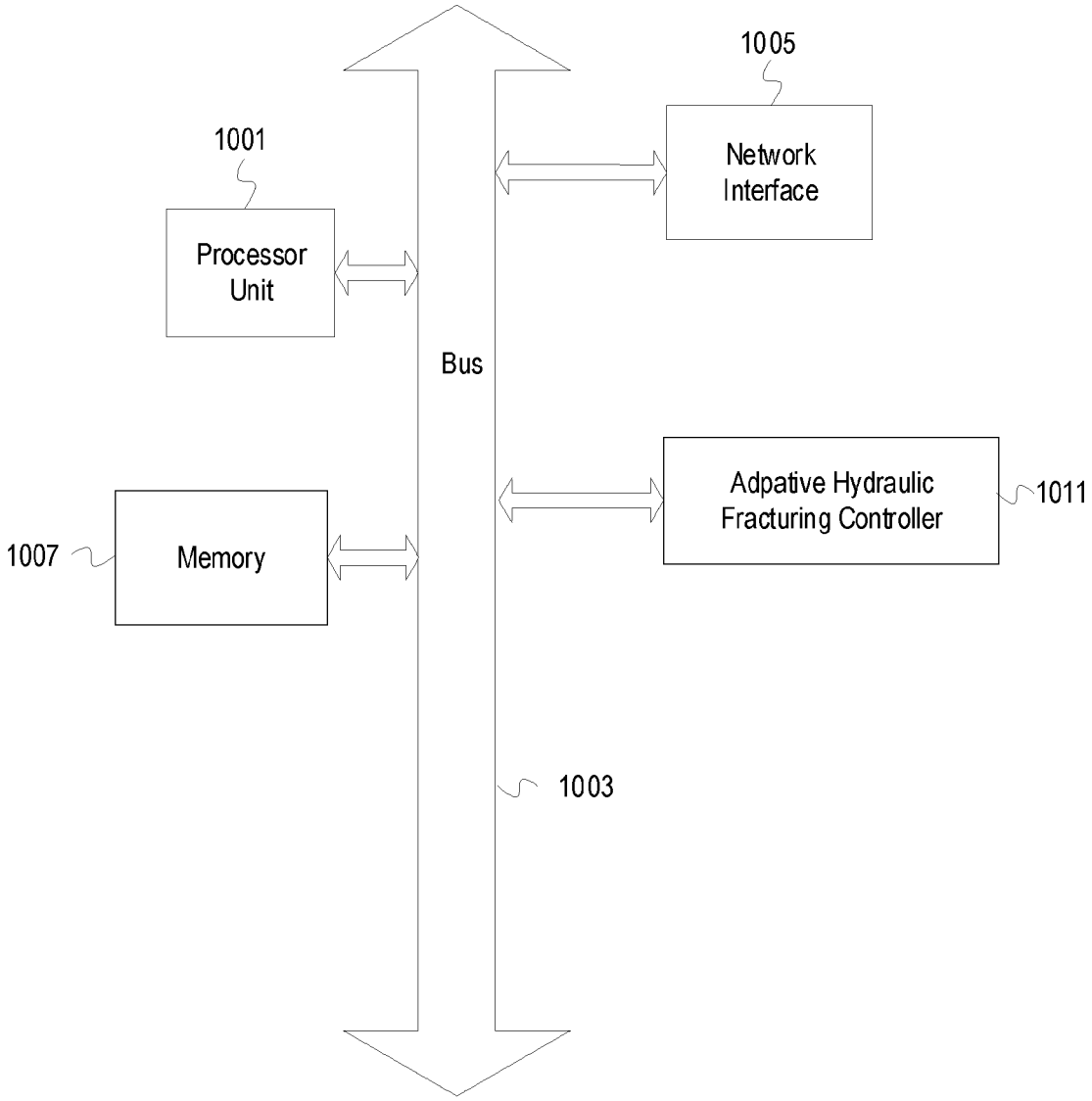
FIG. 10 is a schematic diagram of the control layout for the master controller of FIG. 1.

FIG. 10 depicts an example computer system with an adaptive hydraulic fracturing controller. The computer system includes a processor unit 1001 (possibly including multiple processors, multiple cores, multiple nodes, and/or implementing multi-threading, etc.). The computer system includes memory 1007. The memory 1007 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 1003 (e.g., PCI, ISA, PCI-Express, HyperTransport® bus, InfiniBand® bus, NuBus, etc.) and a network interface 1005 (e.g., a Fiber Channel interface, an Ethernet interface, an internet small computer system interface, SONET interface, wireless interface, etc.). The system also includes an adaptive hydraulic fracturing controller 1011. The adaptive hydraulic fracturing controller 1011 provides automated control of a pump system during a hydraulic fracturing operation. The ticket is used to gain access to an SSO resource in an SSO environment. Any one of the previously described functionalities may be partially (or entirely) implemented in hardware and/or on the processing unit 1001. For example, the functionality may be implemented with an application specific integrated circuit, in logic implemented in the processing unit 1001, in a co-processor on a peripheral device or card, etc. Further, realizations may include fewer or additional components not illustrated in FIG. 10 (e.g., video cards, audio cards, additional network interfaces, peripheral devices, etc.). The processor unit 1001 and the network interface 1005 are coupled to the bus 1003. Although illustrated as being coupled to the bus 1003, the memory 1007 may be coupled to the processor unit 1001.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

EXAMPLE EMBODIMENTS

A. A method that includes sending a first command from a controller to a pump to achieve a first target flow rate for a fracturing fluid being injected into a subterranean formation during a fracturing operation; monitoring an injection property of the fracturing operation; determining a rate of change of the pressure over a first time period; determining, by the controller, a second target flow rate based, at least in part, on the rate of change of the injection property; and sending a second command from the controller to the pump to achieve the second target flow rate for the fracturing fluid.

B. A fracturing control system that includes a fluid system that mixes and dispenses a fracturing fluid; a proppant system that conveys proppant to the fluid system to be included in the fracturing fluid; a pump receives and conveys the fracturing fluid into a wellbore to hydraulically fracture a subterranean formation; and a controller communicably coupled to and configured to operate the fluid system, the proppant system, and the pump. The controller comprises a processor and a machine-readable medium having program code executable by the processor. The program code executable by the processor causes the controller to send a first command to the pump to achieve a first target flow rate for a fracturing fluid being injected into a subterranean formation; monitor a pressure of the fracturing fluid being injected into the subterranean formation; determine a rate of change of the pressure over a first time period; determine a second target flow rate based, at least in part, on the rate of change of the pressure; and send a second command to the pump to achieve the second target flow rate for the fracturing fluid.

C. One or more non-transitory machine-readable media comprising program code, the program code to send a first command to the pump to achieve a first target flow rate for a fracturing fluid being injected into a subterranean formation; monitor a pressure of the fracturing fluid being injected into the subterranean formation; determine a rate of change of the pressure over a first time period; determine a second target flow rate based, at least in part, on the rate of change of the pressure; and send a second command to the pump to achieve the second target flow rate for the fracturing fluid.

Each of the embodiments A, B, and C may have one or more of the following additional elements in any combination.

Element 1: wherein determining the second target flow rate based, at least in part, on the rate of change of the pressure comprises, based on determining that the rate of change over the first time period indicates an increase exceeding a first threshold, reducing a value of a flow rate step; based on determining that the rate of change over the first time period indicates a decrease exceeding a second threshold, increasing the value of the flow rate step; and determining the second target flow rate to be the first target flow rate plus the flow rate step.

Element 2: wherein determining the second target flow rate based, at least in part, on the rate of change of the pressure comprises, based on determining that the rate of change falls within a first range of a set of ranges, identifying a flow rate step associated with the first range; and determining the second target flow rate to be the first target flow rate plus the flow rate step associated with the first range.

Element 3: further comprising based on the pressure of the fracturing fluid being injected into the subterranean formation, determining, by the controller, to increase a flow rate of the fracturing fluid; wherein sending the second command from the controller to the pump is in response to determining to increase the flow rate.

Element 4: wherein determining to increase the flow rate of the fracturing fluid comprises determining that the rate of change of the first time period indicates that the pressure is decreasing.

Element 5: wherein determining to increase the flow rate of the fracturing fluid comprises determining that a maximum time for the first target flow rate has expired.

Element 6: further comprising comparing the rate of change for the first time period to a rate of change for a previous time period; based on determining that the rate of change for the first time period is greater than the rate of change for the previous time period, increasing the maximum time; and based on determining that the rate of change for the first time period is less than the rate of change for the previous time period, decreasing the maximum time.

Element 7: wherein the injection property comprises at least one of a pressure of the fracturing fluid, a pressure amplitude in response to achieving the first target flow rate, hydraulic power of the pump, and rotations per minute of the pump.

Element 8: based on the injection property of the fracturing operation, determining, by the controller, to increase a flow rate of the fracturing fluid; wherein sending the second command from the controller to the pump is in response to determining to increase the flow rate.

Element 9: wherein determining to increase the flow rate of the fracturing fluid comprises determining that the rate of change of the first time period indicates that the injection property is decreasing.

By way of non-limiting example, exemplary combinations applicable to A, B, and C include: Element 4 with Element 3, Element 5 with Element 3, and Element 7 with Elements 3 and 5.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed is:

1. A method comprising:

sending a first command from a controller to a pump to achieve a first target flow rate for a fracturing fluid being injected into a subterranean formation during a fracturing operation;

monitoring an injection property of the fracturing operation;

determining a rate of change of the injection property over a first time period;

determining, by the controller, a second target flow rate based, at least in part, on the rate of change of the injection property, wherein determining the second target flow rate comprises, based on determining that the rate of change over the first time period indicates an increase or a decrease exceeding a threshold, reducing or increasing a value of a flow rate step; and determining the second target flow rate to be the first target flow rate plus the flow rate step; and sending a second command from the controller to the pump to achieve the second target flow rate for the fracturing fluid.

2. The method of claim 1, wherein the injection property comprises at least one of a pressure of the fracturing fluid, a pressure amplitude in response to achieving the first target flow rate, hydraulic power of the pump, and rotations per minute of the pump.

3. The method of claim 1, wherein determining the second target flow rate based, at least in part, on the rate of change of the injection property comprises:

based on determining that the rate of change over the first time period indicates an increase exceeding a first threshold, reducing a value of a flow rate step;

based on determining that the rate of change over the first time period indicates a decrease exceeding a second threshold, increasing the value of the flow rate step; and determining the second target flow rate to be the first target flow rate plus the flow rate step.

4. The method of claim 1, wherein determining the second target flow rate based, at least in part, on the rate of change of the injection property comprises:

based on determining that the rate of change falls within a first range of a set of ranges, identifying a flow rate step associated with the first range; and determining the second target flow rate to be the first target flow rate plus the flow rate step associated with the first range.

5. The method of claim 1 further comprising:

based on the injection property of the fracturing operation, determining, by the controller, to increase a flow rate of the fracturing fluid;

wherein sending the second command from the controller to the pump is in response to determining to increase the flow rate.

6. The method of claim 5, wherein determining to increase the flow rate of the fracturing fluid comprises determining that the rate of change of the first time period indicates that the injection flow property is decreasing.

7. The method of claim 5, wherein determining to increase the flow rate of the fracturing fluid comprises determining that a maximum time for the first target flow rate has expired.

8. The method of claim 7, further comprising:

comparing the rate of change for the first time period to a rate of change for a previous time period;

based on determining that the rate of change for the first time period is greater than the rate of change for the previous time period, increasing the maximum time; and based on determining that the rate of change for the first time period is less than the rate of change for the previous time period, decreasing the maximum time.

9. A fracturing control system comprising:

a fluid system that mixes and dispenses a fracturing fluid;

a pump which receives and conveys the fracturing fluid into a wellbore to hydraulically fracture a subterranean formation; and a controller communicably coupled to and configured to operate the pump, wherein the controller comprises a processor and a machine-readable medium having program code executable by the processor to cause the controller to:

send a first command to the pump to achieve a first target flow rate for a fracturing fluid being injected into a subterranean formation;

monitor a pressure of the fracturing fluid being injected into the subterranean formation;

determine a rate of change of the pressure over a first time period;

determine a second target flow rate based, at least in part, on the rate of change of the pressure, wherein determining the second target flow rate comprises, based on determining that the rate of change over the first time period indicates an increase or a decrease exceeding a threshold, reducing or increasing a value of a flow rate step; and determining the second target flow rate to be the first target flow rate plus the flow rate step; and send a second command to the pump to achieve the second target flow rate for the fracturing fluid.

10. The fracturing control system of claim 9, wherein the program code executable by the processor to cause the controller to determine the second target flow rate based, at least in part, on the rate of change of the pressure comprises program code executable by the processor to cause the controller to:

based on a determination that the rate of change over the first time period indicates an increase exceeding a first threshold, reduce a value of a flow rate step;

based on a determination that the rate of change over the first time period indicates a decrease exceeding a second threshold, increase the value of the flow rate step; and determine the second target flow rate to be the first target flow rate plus the flow rate step.

11. The fracturing control system of claim 9, wherein the program code executable by the processor to cause the controller to determine the second target flow rate based, at least in part, on the rate of change of the pressure comprises program code executable by the processor to cause the controller to:

based on a determination that the rate of change falls within a first range of a set of ranges, identify a flow rate step associated with the first range; and determine the second target flow rate to be the first target flow rate plus the flow rate step associated with the first range.

12. The fracturing control system of claim 11, wherein the program code executable by the processor to cause the controller to determine to increase the flow rate of the fracturing fluid comprises program code executable by the processor to cause the controller to determine that a maximum time for the first target flow rate has expired.

13. The fracturing control system of claim 12, wherein the program code further comprises program code executable by the processor to cause the controller to:

compare the rate of change for the first time period to a rate of change for a previous time period;

based on a determination that the rate of change for the first time period is greater than the rate of change for the previous time period, increase the maximum time; and based on a determination that the rate of change for the first time period is less than the rate of change for the previous time period, decrease the maximum time.

14. The fracturing control system of claim 9, wherein the program code further comprises program code executable by the processor to cause the controller to:

based on the pressure of the fracturing fluid being injected into the subterranean formation, determine, by the controller, to increase a flow rate of the fracturing fluid;

wherein the program code executable by the processor to cause the controller to send the second command from the controller to the pump is executed in response to determining to increase the flow rate.

15. The fracturing control system of claim 14, wherein the program code executable by the processor to cause the controller to determine to increase the flow rate of the fracturing fluid comprises program code executable by the processor to cause the controller to determine that the rate of change of the first time period indicates that the pressure is decreasing.

16. One or more non-transitory machine-readable media having program code stored therein, the program code to:

send a first command to a pump to achieve a first target flow rate for a fracturing fluid being injected into a subterranean formation;

monitor a pressure of the fracturing fluid being injected into the subterranean formation;

determine a rate of change of the pressure over a first time period;

determine a second target flow rate based, at least in part, on the rate of change of the pressure, wherein determining the second target flow rate comprises, based on determining that the rate of change over the first time period indicates an increase or a decrease exceeding a threshold, reducing or increasing a value of a flow rate step; and determining the second target flow rate to be the first target flow rate plus the flow rate step; and send a second command to the pump to achieve the second target flow rate for the fracturing fluid.

17. The machine-readable media of claim 16, wherein the program code to determine the second target flow rate based, at least in part, on the rate of change of the pressure comprises program code to:

based on a determination that the rate of change over the first time period indicates an increase exceeding a first threshold, reduce a value of a flow rate step;

based on a determination that the rate of change over the first time period indicates a decrease exceeding a second threshold, increase the value of the flow rate step; and determine the second target flow rate to be the first target flow rate plus the flow rate step.

18. The machine-readable media of claim 16, wherein the program code to determine the second target flow rate based, at least in part, on the rate of change of the pressure comprises program code to:

based on a determination that the rate of change falls within a first range of a set of ranges, identify a flow rate step associated with the first range; and determine the second target flow rate to be the first target flow rate plus the flow rate step associated with the first range.

19. The machine-readable media of claim 18, wherein the program code to determine to increase the flow rate of the fracturing fluid comprises program code to determine that a maximum time for the first target flow rate has expired.

20. The machine-readable media of claim 19, wherein the program code further comprises program code to:

compare the rate of change for the first time period to a rate of change for a previous time period;

based on a determination that the rate of change for the first time period is greater than the rate of change for the previous time period, increase the maximum time; and based on a determination that the rate of change for the first time period is less than the rate of change for the previous time period, decrease the maximum time.

* * * * *